US005182581A

United States Patent [19]

Kashimura et al.

[11] Patent Number: 5,182,581

[45] Date of Patent: Jan. 26, 1993

[54] INK JET RECORDING UNIT HAVING AN INK TANK SECTION CONTAINING POROUS MATERIAL AND A RECORDING HEAD SECTION

[75] Inventors: Makoto Kashimura, Tokyo; Hiroshi Nakagomi, Yamato; Seiichiro Karita; Tsuguhiro Fukuda, both of Yokohama; Tetsuo Kimura, Sagamihara; Hirofumi Hirano, Yokohama; Mitsuru Kurata, Kawasaki, all of Japan

[73] Assignee: Canon Kabushiki Kaisha, Tokyo, Japan

[21] Appl. No.: 747,487

[22] Filed: Aug. 19, 1991

Related U.S. Application Data

[63] Continuation of Ser. No. 641,331, Jan. 15, 1991, abandoned, which is a continuation of Ser. No. 385,152, Jul. 26, 1989, abandoned.

[30] Foreign Application Priority Data

| | | | |
|---|---|---|---|
| Jul. 26, 1988 | [JP] | Japan | 63-184690 |
| Jul. 26, 1988 | [JP] | Japan | 63-184693 |
| Jul. 26, 1988 | [JP] | Japan | 63-184695 |
| Jul. 26, 1988 | [JP] | Japan | 63-184697 |
| Jul. 26, 1988 | [JP] | Japan | 63-184698 |
| Apr. 25, 1989 | [JP] | Japan | 1-105488 |

[51] Int. Cl.[5] ..... B41J 2/175

[52] U.S. Cl. ..... 346/140 R

[58] Field of Search ..... 346/140 R

[56] References Cited

U.S. PATENT DOCUMENTS

| | | | |
|---|---|---|---|
| 3,953,862 | 4/1976 | Amberntsson | 346/140 |
| 4,025,928 | 5/1977 | Hou | 346/140 |
| 4,095,237 | 6/1978 | Amberntsson | 346/140 |
| 4,306,245 | 12/1981 | Kasugayama et al. | 346/140 R |
| 4,368,478 | 7/1983 | Koto | 346/140 |
| 4,589,000 | 5/1986 | Koto | 346/140 |
| 4,771,295 | 9/1988 | Baker | 346/140 X |
| 4,875,059 | 10/1989 | Masuda | 346/140 R |

FOREIGN PATENT DOCUMENTS 63-281850 11/1988 Japan .

*Primary Examiner*—Joseph W. Hartary

*Attorney, Agent, or Firm*—Fitzpatrick, Cella, Harper & Scinto

[57] ABSTRACT

An ink tank for storing recording ink comprises an ink storage section including an ink holding member for holding ink and substantially entirely occupying an ink storage space and a ventilation section having a vent hole communicating with the interior of the ink tank with atmosphere, the ventilation section including an ink-repellent member having an ink-repellent character. The ink holding member can be formed of one porous member or two porous members, one of high and one of low porosity. The member with high porosity is provided adjacent an ink supply port. An ink jet recording head also comprises the same ink tank and an ink jet recording head section including an ink discharge port for discharging ink, an ink passage communicating with the ink discharge port and an energy generation element for generating energy utilized for ink discharged. Further an ink jet recording apparatus includes the same ink jet recording head.

44 Claims, 15 Drawing Sheets

INK JET RECORDING UNIT HAVING AN INK TANK SECTION CONTAINING POROUS MATERIAL AND A RECORDING HEAD SECTION

This application is a continuation of application Ser. No. 07/641,331 filed Jan. 15, 1991, now abandoned, which in turn is a continuation of application Ser. No. 07/385,152, filed Jul. 26, 1989, now abandoned.

BACKGROUND OF THE INVENTION

1. Field of the Invention

This invention relates to an ink tank for retaining ink.

The invention also relates to an ink jet recording head of cartridge type, in which an ink tank and a recording head section are integrally accommodated in a housing, and which can be mounted on and dismounted from a recording apparatus.

The invention further relates to an ink jet recorder with such an ink jet recording head.

2. Related Background Art

As an ink jet recording head, in which an ink discharge section for discharging recording liquid (hereinafter referred to as "ink") for recording and an ink tank or reservoir containing the ink to be supplied to the ink discharge section are integrally accommodated in a housing, there are those shown in U.S. Pat. Nos. 3,953,862 and 4,095,237 and also there is one as shown in FIGS. 1A and 1B.

In the recording head shown in the U.S. Pat. No. 3,953,862, a water-repellent filter is provided in an air-communication hole of an ink tank.

The filter in this recording head, however, is disposed in a plug constituting an air-communication port such that it is found on the inner surface of the ink tank. Therefore, the head has problem of leakage of ink through a gap between the plug and ink tank body and also those concerning the continued effect of the water-repellent filter.

In the recording head shown in the U.S. Pat. No. 4,095,237, ink is retained by an ink carrier, and the neighborhood of an air-communication hole is provided with no means against ink leakage. Therefore, ink leakage may occur. In addition, it is liable that air reaches the recording head through a gap between the ink carrier and ink tank, resulting in instable discharge of ink.

In the ink jet recording head shown in FIGS. 1A and 1B, which is generally designated at 101, an ink containing section (hereinafter referred to as "ink tank") 102 and an ink discharge section (or also referred to as "recording head section") 103 having a function of discharging ink are constructed integrally. The ink discharge section 103 has an ink discharge port provided in an ink discharge face thereof. The ink tank 102 consists of a housing 106 as an outer cover and a lid 107. In the ink tank 102, a porous material 108 is accommodated as ink carrier in the ink tank 102 to prevent ink from being moved or leaking to the outside when the ink tank experiences sudden shocks or the like. An ink-carrying section 109 of the porous material 108 is impregnated with ink, so that ink can be supplied to the ink discharge section 103. Reference numeral 110 designates a vent hole communicating the ink tank 102 with atmosphere. The ink tank inner pressure is held constant by the vent hole 110.

A portion 111 of the porous material 108 on the side of the vent hole 110 is an ink-repellent portion obtained by a repellent treatment. This ink-repellent portion 111 prevents ink from leaking through the vent hole 110 to the outside.

Ink in the ink tank 102 is passed through a filter 105 for separating dust or the like and then supplied to the ink discharge section 103 and discharged through the discharge port 104 by discharge energy generation means (not shown) such as a heat-generating resistor.

As ink in the ink tank 102 is consumed, air is supplied to the ink-carrying portion 109 through the vent hole 110. In this way, the inner pressure of the ink tank is held constant to maintain optimum ink discharge characteristics.

The recording head 101 having the above construction is mounted on a carriage 1111 as shown in FIG. 2, and it is secured to the carriage 1111 by keeping members 1112. While the carriage 1111 is moved along guide bars 1115 by a drive wire 1113 and a drive motor 1114, the recording head 101 discharges ink in a direction of arrows Z for recording on a recording sheet 1116. Reference numeral 1117 designates a platen for supporting the recording sheet 1116, 1118 a sheet feed motor for causing the platen 1117 to feed the sheet, and 1119 flexible wiring for supplying an ink discharge signal to the recording head 101 for recording.

With the above prior art ink jet recording head 101 of integral type, however, ink is retained by impregnating the porous material 108 accommodated in the ink tank 102 with the ink, and also the ink tank 102 has the vent hole 110. Therefore, when the recording head 101 experiences vibrations or shocks, ink carried by the ink-carrying portion 109 is liable to flow into space 114 without being prevented by the liquid-repellent or ink-repellent portion 111, or occasional pressure application to the housing 106 during handling of the recording head 101 may cause leakage of such ink through the vent hole 110, thus contaminating inner and outer portions of the ink jet recording apparatus or hands or clothes of the operator or being attached to an electric connection section (not shown) of the recording apparatus to result in rupture of the recording apparatus.

Further, since the porous material 108 is pressure-loaded in the ink tank 102, it is greatly squeezed, and its porisity is reduced. Therefore, the ink tank has a small ink-retaining capacity, usually 50% or below, despite its large volume. If it is intended to increase the filling amount of retained ink, leakage of ink 109 through the vent hole 110 is liable in such case as when the posture of the head is altered, thus leading to the problems noted above. Further, a large amount of ink remains without being used, that is, the percentage of ink consumption is low in spite of a large ink tank volume, and it is necessary to increase the volume of the ink tank in order to ensure a large amount of ink capable of consumption.

Still further, with the above prior art ink jet recording head 101 of integral type, bubbles of air or the like mixed in ink are liable to be led together with ink in the ink tank 102 to the ink discharge section 103. This has adverse effects on the ink discharge characteristics and will cause defective discharge or failure of discharge of ink. Particularly, such bubbles are led through a gap 114 between the inner wall surface of the ink tank 102 and porous material 108 toward the ink discharge section 103 as shown by arrows A in FIG. 1B. Therefore, it is necessary to block such route of bubbles.

Further problems in the prior art ink jet recording head reside in the air vent hole structure for communicating the ink tank with atmosphere. U.S. Pat. No.

4,306,245 discloses a structure, in which two vent holes communicating an ink tank with atmosphere are provided at predetermined positions on ink tank side wall.

In this structure, a predetermined space is provided between an ink accommodation zone, in which ink is accommodated, and atmosphere, and the ink accommodation zone is communicated with atmosphere through that space and the two vent holes.

In this case, leakage of ink to the outside is readily caused by the tilting or vibrations of the ink tank because of the presence of the two vent holes, causing contamination of the recording apparatus or hands or clothes of the operator and also resulting in waste of ink.

In a further aspect, in a recording head, in which the ink tank and recording head section are constructed integrally, usually an ink passage for leading ink from the ink tank to the ink discharge section and an ink injection passage for sealing ink in the ink tank are provided separately. In case where the ink tank is provided with an ink injection hole, through which ink is supplied, it is liable that ink is attached to the wall of the hole and closes the hole or that the hole wall is wetted to result in dust collection thereon. In either case, stable ink supply is no longer possible.

Besides, where the ink passage for leading ink from the ink tank to the ink discharge section and ink injection passage for sealing ink in the ink tank are provided separately, complicated construction is inevitable, and also it is difficult to reliably fill both the ink tank and ink discharge section with ink.

There is a further prior art structure, in which a porous film is provided at an air-communication port to prevent leakage of ink through the vent hole 110 as noted before. In this case, however, it is liable that pores of the porous film are closed by dried ink to produce a sealed state of the ink tank inside. In such a case, with the progress of recording an excessive burden is produced in the ink tank inside, thus resulting in defective discharge of the ink or the like.

SUMMARY OF THE INVENTION

The present invention is intended in the light of and in order to solve the above problems concerning the vent hole provided in the ink tank and has the following objects.

One object of the invention is to provide, in the light of and in order to solve the problems noted above, an ink tank, which is free from leakage of ink through vent hole during its handling or due to vibrations or shocks, is highly reliable and can be used conveniently.

Another object of the invention is to provide, in the light of and in order to solve the problems noted above, an ink tank, which can prevent bubbles from being led along its inner wall surface to an ink discharge section.

A further object of the invention is to provide, in the light of and in order to solve the problems noted above, an ink jet recording head, which has high ink charging efficiency, is free from ink leakage from any vent hole, is highly reliable and can be used with high efficiency.

A still further object of the invention is to provide, in the light of and in order to solve the problems noted above, an ink jet recording head, which is provided with an ink tank in which ink is prevented from being led to a vent hole, thus preventing ink leakage from the vent hole.

A yet further object of the invention is to provide, in the light of and in order to solve the problems noted above, an ink jet recording head, in which an ink passage can also serve as an ink injection passage so that there is no need of providing any particular ink injection hole, while permitting reliable charging of ink to both the ink tank and ink discharge section.

Still another object of the invention is to provide, in the light of and in order to solve the problems noted above, an ink jet recording head, which can prevent bubbles from being led along ink tank inner wall surface to an ink discharge section, thus precluding defective unstable discharge of ink.

Yet another object of the invention is to provide, in the light or and in order to solve the problems noted above, an ink jet recording apparatus with an ink jet recording head, which has high ink charging efficiency, is free from leakage of ink from any vent hole during its handling or due to the vibrations or shocks and can prevent bubbles from being led along ink tank inner wall surface to an ink discharge section, thus precluding defective or unstable discharge of ink.

DETAILED DESCRIPTION OF THE PREFERRED EMBODIMENTS

Preferred embodiments of the invention will now be described in detail with reference to the drawings.

Figure 3:
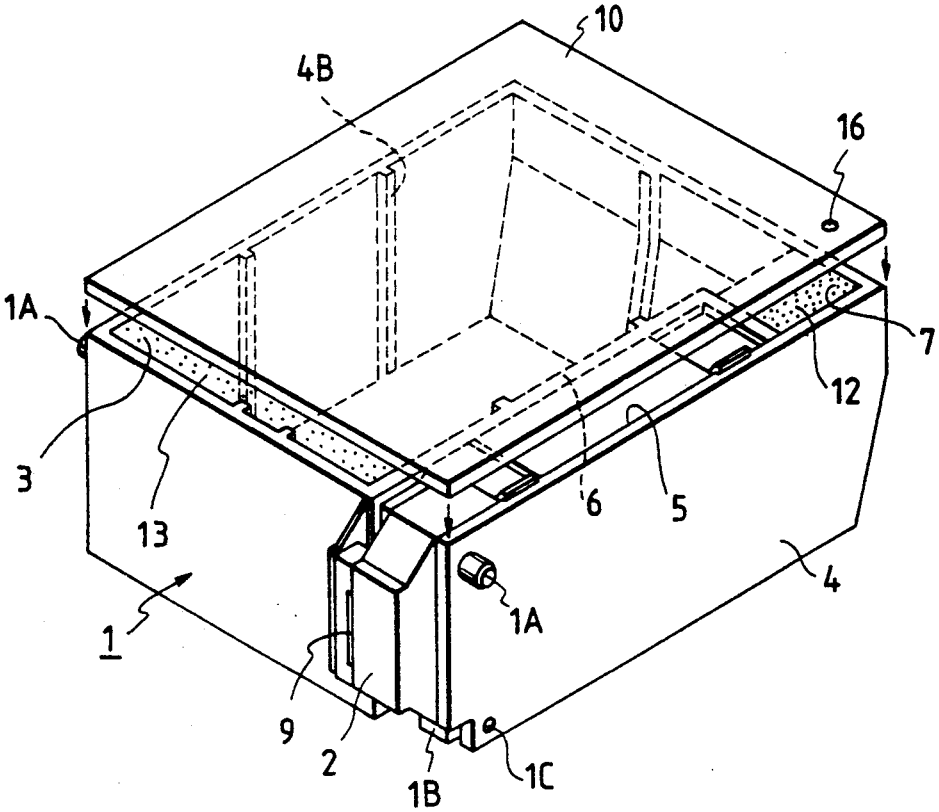
FIG. 3 is a schematic exploded perspective view showing an ink jet recording head embodying the invention.

FIG. 3 is an exploded perspective view showing an ink jet recording head embodying the invention.

In the Figure, reference numeral 3 designates an ink tank, and 2 an ink discharge unit (or recording head section), which is inserted into the ink tank 3 along a side wall thereof and disposed at a predetermined location. Ink is supplied to the ink discharge unit 2 from an ink supply duct (not shown) leading from the bottom of the ink tank 3. The ink discharge unit 2 has an ink discharge port 9, through which ink is discharged for recording according to a recording signal supplied from a recording apparatus side through an electrode section which is also provided in the ink discharge unit 2.

The discharge of ink from the ink discharge port is caused by heat generation in a heat generating section which is disposed at a predetermined position in the unit 2. The heat generating section generates heat in response to application of a predetermined pulse voltage to a conducting section connected to it. When this voltage is applied, ink in the neighborhood of the heat generating section is momentarily caused by the generated heat energy to undergo a status change to form bubbles. The bubbles thus formed grow quickly in an ink passage, and with a pressure built up at this time ink found on the side of the ink discharge port is quickly forced out through the port to fly as ink drops and be attached to a recording medium. In this way, recording is effected. When the applied voltage vanishes, bubbles are quickly reduced and disappear.

The ink discharge unit used according to the invention is not limited to the type utilizing heat energy as described above, but it is also possible to use an ink discharge unit, which utilizes an electromechanical transducer as discharge energy generation element.

Reference numeral 13 designates a porous material, for instance urethane foam, serving as an ink-carrier. The porous material 13 is disposed in the ink tank 1 such as to occupy substantially the entire inner space. Reference numeral 10 designates a lid, which constitutes part of the ink tank 3 and is secured to the rest thereof to cover the porous material 13 and ink discharge unit 2. The lid 10 has a vent hole 16.

Reference numeral 12 designates an ink repellent porous material consisting of urethane foam or polyethylene foam treated to have an ink-repellent character. The material 12 is disposed in an ink tank inner space not occupied by the porous material 13, i.e., a space formed as a ventilation space 7 between the porous material 13 and vent hole 16. When the lid 10 is secured to the rest of the ink tank 3, the ink-repellent porous material 12 is held in close contact with the vent hole 16.

With the above structure, ink can not migrate into the ink-repellent porous material 12, while the porous structure ensures air flow. Thus, no ink is led to the vent hole 16, and leakage of ink through the vent hole 16 is eliminated.

Figure 4:
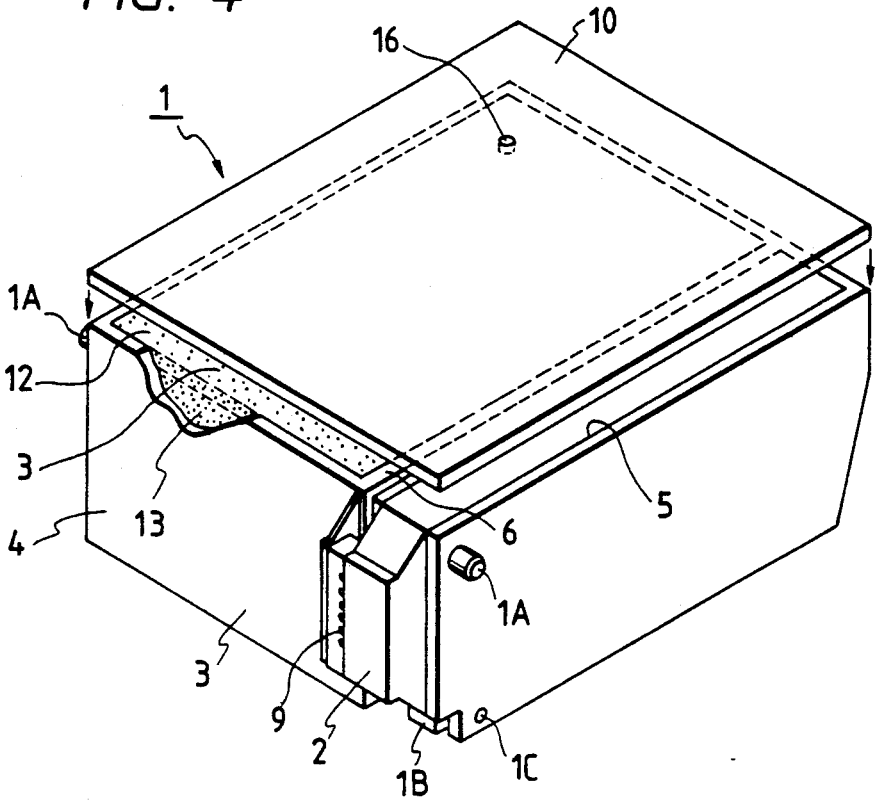
FIGS. 4 and 5 are exploded perspective views showing further embodiments of the ink jet recording head according to the invention.

FIG. 4 is an exploded perspective view showing a different embodiment of the ink jet recording head according to the invention. In this instance, an ink-repellent porous material 12 is provided as a layer over the entire top of an ink tank 3.

With this structure, further improved sealing properties against ink leakage can be obtained.

Figure 5:
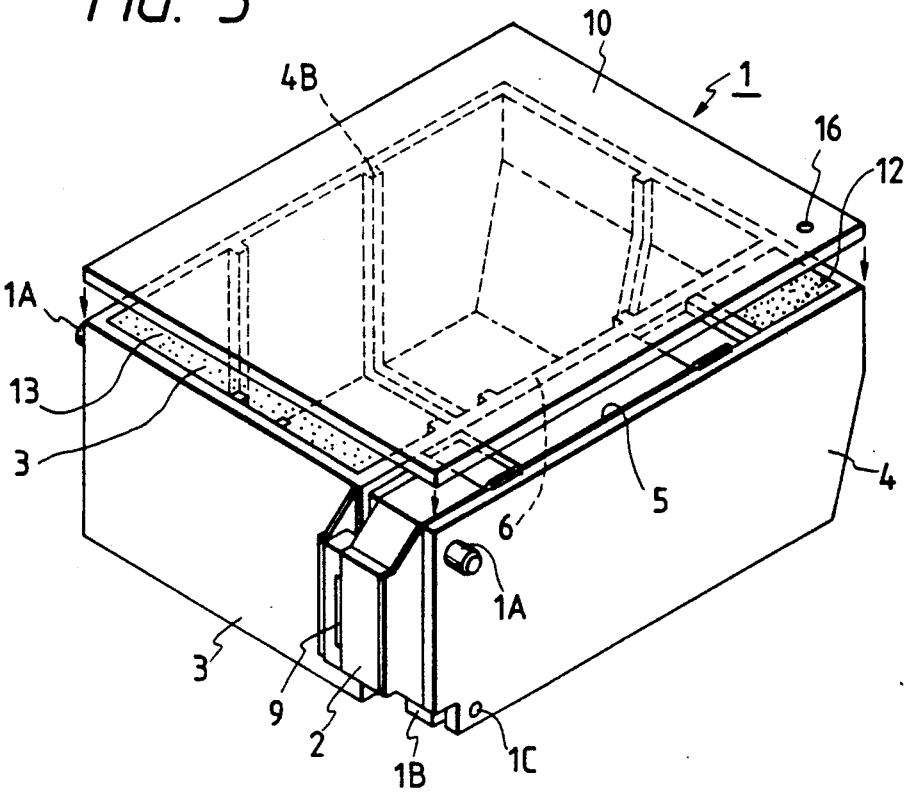

FIG. 5 is an exploded perspective view showing a further embodiment of the ink jet recording head according to the invention. In this instance, a partitioning wall is provided partially between an ink storage space, in which a porous material 13 is provided, and a space occupied by an ink-repellent porous material 12. Thus, the area of contact between ink and ink-repellent porous material 12 is reduced to obtain still further improvement of the seal of ink against leakage.

In each of the above embodiments, the porous material has a structure, in which numerous pores communicate with one another three-dimensionally. Therefore, unlike a porous film in which pores are arranged two-dimensionally, three-dimensional contact with ink is obtained, and the entire porous structure is never closed although some pores may be closed by attached dried ink. Cummunication with atmosphere thus is ensured.

Figure 6A:
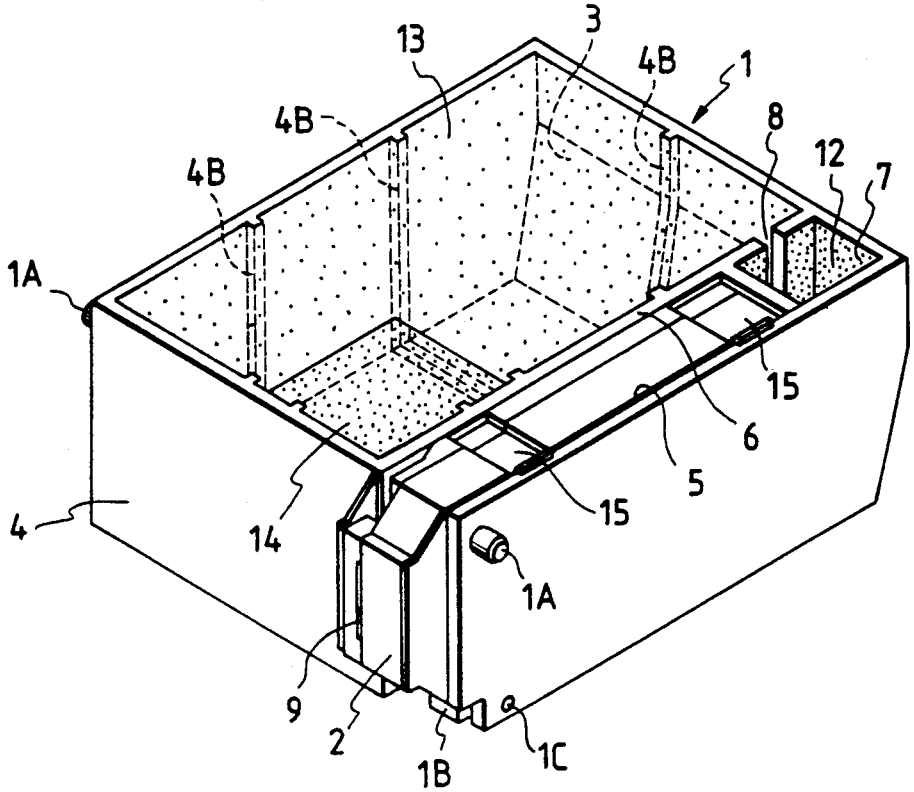
FIG. 6A is a perspective view showing an example of the structure of the ink jet recording head according to the invention.
Figure 6B:
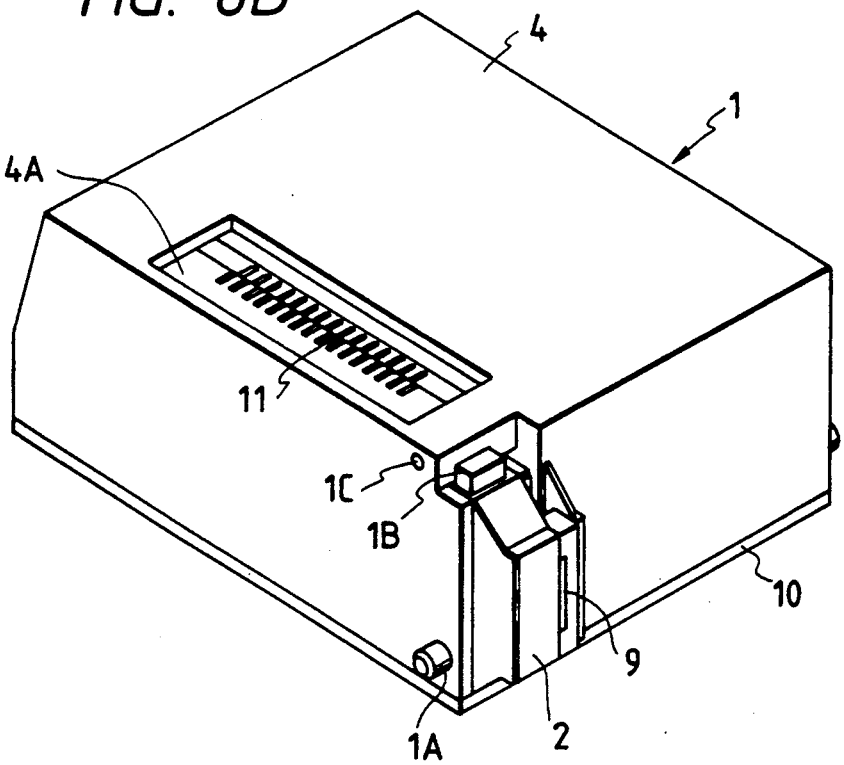
FIG. 6B is a back side perspective view showing the recording head of FIG. 6A.

FIGS. 6A and 6B show a further mode of the ink jet recording head.

FIG. 6A shows a further embodiment of the invention. Referring to FIG. 6A, there is shown an ink jet recording head 1, which again is of cartridge type. In this recording head, a housing 4 integrally forms an ink discharge unit 2, which uses a discharge energy generation element and has an ink discharge function, and an ink tank 3. The ink tank 3 and a unit accommodation section 5, in which the ink discharge unit 2 is mounted, are isolated from each other by a partitioning wall 6. Reference numeral 7 designates a ventilation chamber 7 communicated via a communication notch 8 with the ink tank 3. The ink tank 3 is communicated with atmosphere via the ventilation chamber 7 as will be described later in detail.

Reference numeral 9 designates an ink discharge port. In FIG. 6B, reference numeral 10 designates a lid bonded to the housing 4 in a manner as will be described later, and 11 a signal supply electrode section provided on the ink discharge unit 2. To permit connection of the electrode section 11 to a connector (not shown), the bottom of the unit accommodation section 5 is formed with an aperture 4A to expose the section 11. In FIG. 6A, reference numerals 12 to 14 designate elastic porous materials (hereinafter referred to as porous members), which consist of urethane, foam, foamed pulp, foamed PVA (polyvinyl alcohol), etc. and are different in the ink carrying property and ink charging efficiency or ink-repellent property.

Figure 7:
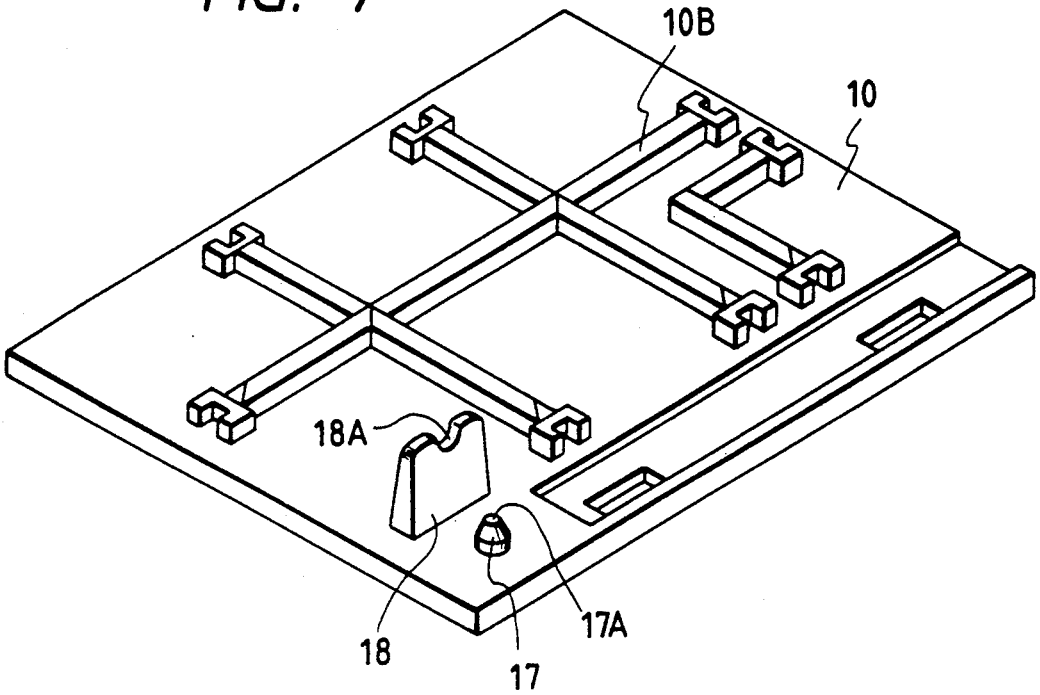
FIG. 7 is a perspective view showing the inner surface of a lid according to the invention.

The porous member 12, which is accommodated in the ventilation chamber 7, is treated to provide ink-repellent property, that is, it is repellent to ink although it permits air flow through it. The porous members 13 and 14 can absorb and carry ink. The porous member 14 has a lower ink charging efficiency but has a greater ink carrying property compared to the porous member 13. The porous members 12 to 14 are loaded in the ink tank 3 and ventilation section 4 as shown in FIG. 6A, and subsequently a lid 10 as shown in FIG. 7 is welded to the housing by highly liquid-tight welding such as ultrasonic welding along a welding line W shown by a phantom line in FIG. 8 such that it urges the porous members 12 to 14.

Figure 9:
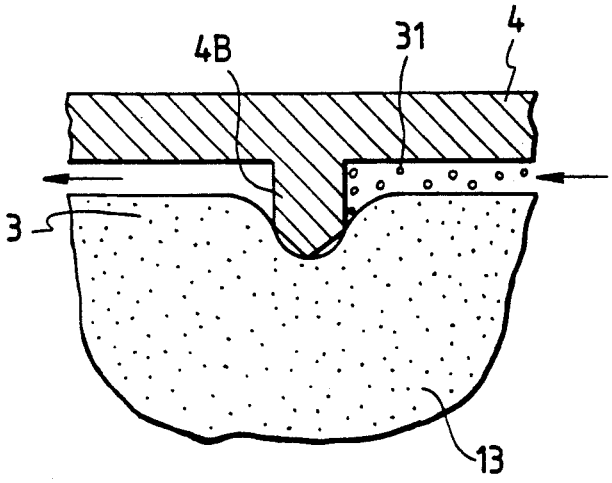
FIG. 9 is a sectional view showing a rib and the neighborhood thereof according to the invention.

The side walls and bottom of the ink tank 3 and lid 10 have their inner surfaces formed at corresponding positions with ribs 4B and 10B having sharp edges. The sharp edges of the ribs 4B and 10B wedge in the porous members 13 and 14 sealed in the ink tank 3, thus preventing air and bubbles 31 in the ink tank 3 from moving through a gap between ink tank wall and porous member to the ink discharge unit 2 as shown in FIG. 9.

In FIG. 6A, designated at 1A are engagement pins, which are engaged with a carriage (not shown) when mounting the recording head 1 in the carriage, 1B a positioning rib at the time of the mounting, and 1C an ink charging hole used when charging ink into the recording head 1. The top of the unit accommodation section 5 is provided with a fixing pawl 15 for fixing the ink discharge unit 2 in a mounted position in the section 5.

Figure 8:
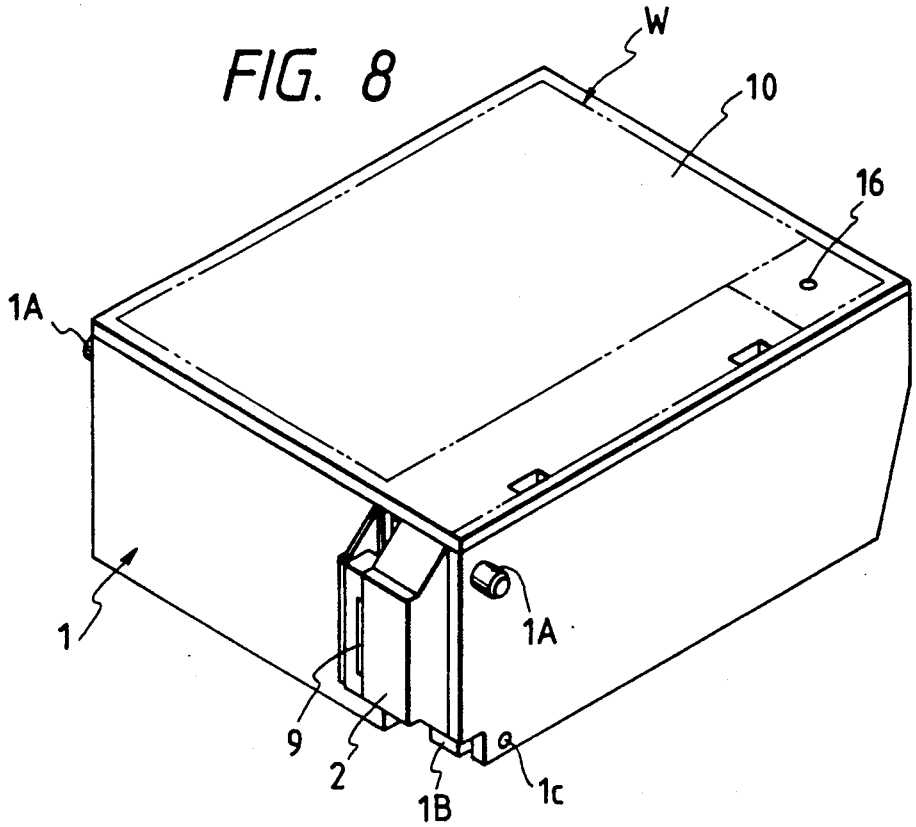
FIG. 8 is an upper side perspective view showing the recording head of FIG. 6A.
Figure 10A:
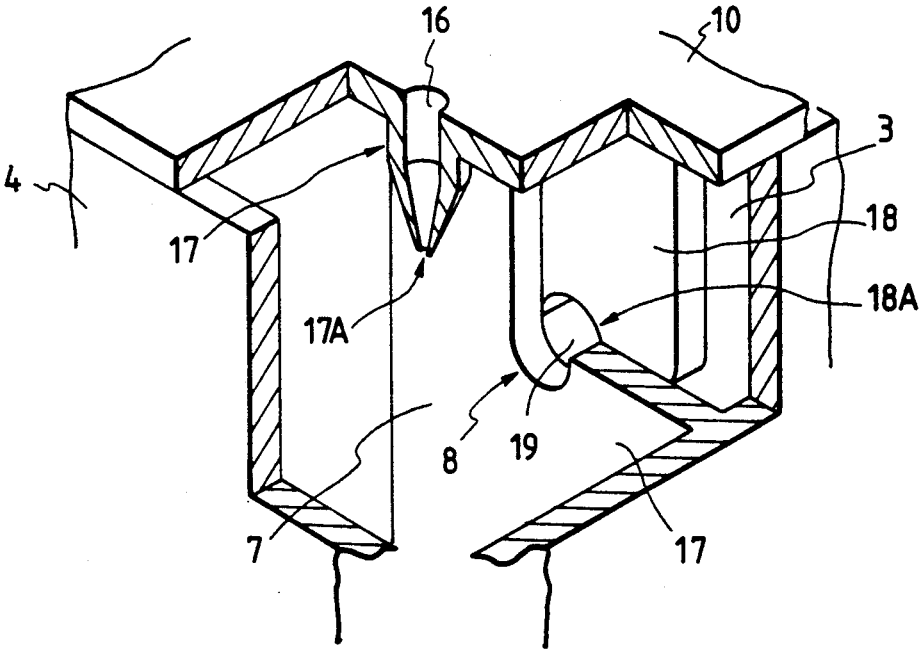
FIG. 10A is a fragmentary perspective view, partially broken apart, showing an example of ventilation section according to the invention.

The construction of the ventilation chamber 7 will now be described in detail with reference to FIGS. 10A and 11. The lid 10 has the vent hole 16 formed over the ventilation section 7 as shown in FIG. 8. As shown in FIG. 10A, a hollow conical projection 17 surrounding the vent hole 16 projects into the ventilation chamber 7. Reference numeral 18 designates a small wall depending from the ceiling of the ink tank 3. The small wall 18 has a semi-circular notch 18A open at the lower end. The notch 18A and communication notch 8 form a circular communication hole 19.

Figure 11:
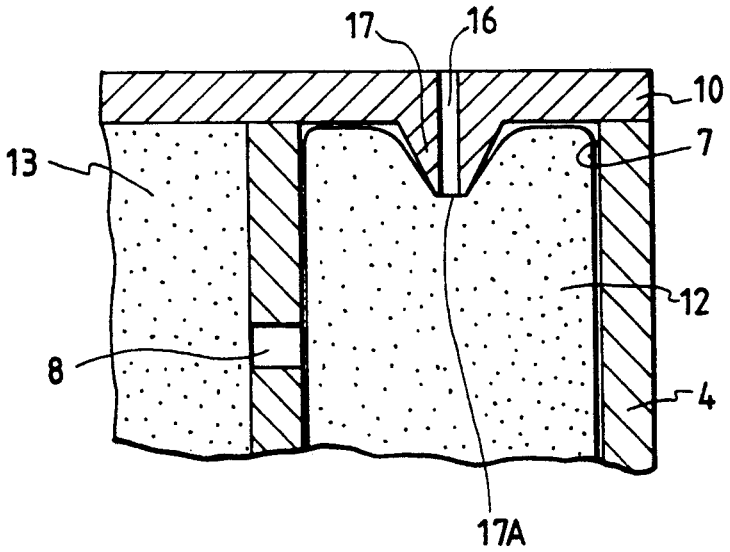
FIGS. 11 and 12 are fragmentary sectional views showing the ventilation section shown in FIG. 10A.

By loading the ink-repellent porous member 12 in the ventilation chamber 7 and sealing the section with the lid 10 from above as shown in FIG. 11, the open end 17A of the hollow conical projection 17 wedges into the porous material 12. Therefore, even if ink is introduced into the ventilation chamber 7 from the side of the ink tank 3 through the communication hole 19, it never migrates into the porous member 12 for the member 12 is ink-repellent.

Further, even if ink is led along the inner wall of the ventilation chamber 7, ink never leaks to the outside through the vent hole 16 for the hollow conical projection 17 projects inwardly and the porous member 12 is in close contact with the open end 17A of the projection such that it wedges into the opening of the end 17A.

Figure 10B:
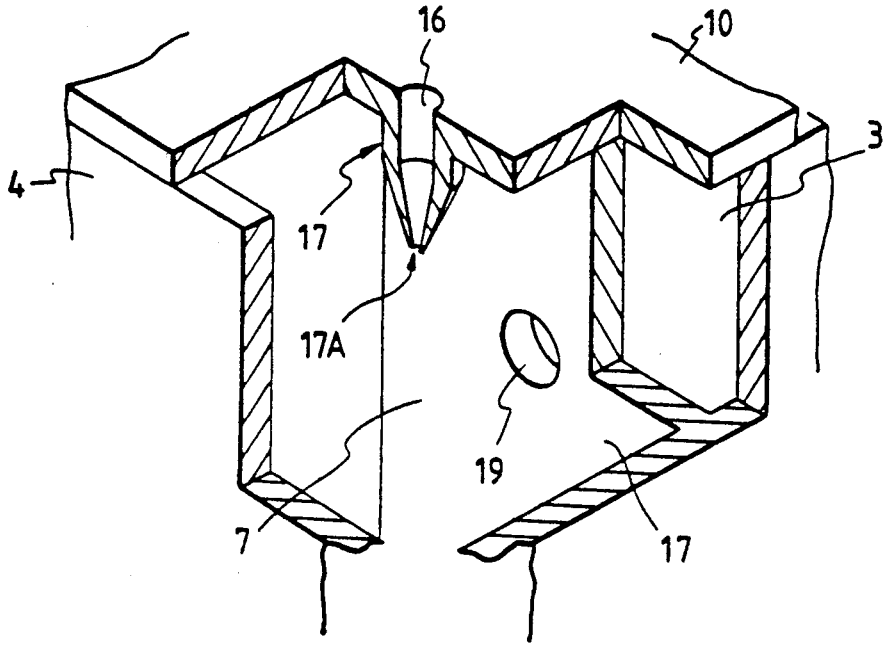
FIG. 10B is a view similar to FIG. 10A but showing a different example of the ventilation section according to the invention.

FIG. 10B shows a different example of the ventilation chamber 7. In this instance, a communication hole 19 is formed in the partitioning wall 17 between the ink tank 3 and ventilation chamber 7. This structure has the same ink leakage prevention effect as described above. In addition, with this structure, there is no need of providing the small wall 18 depending from the lid 10 as in the case of FIG. 10A.

Figure 10C:
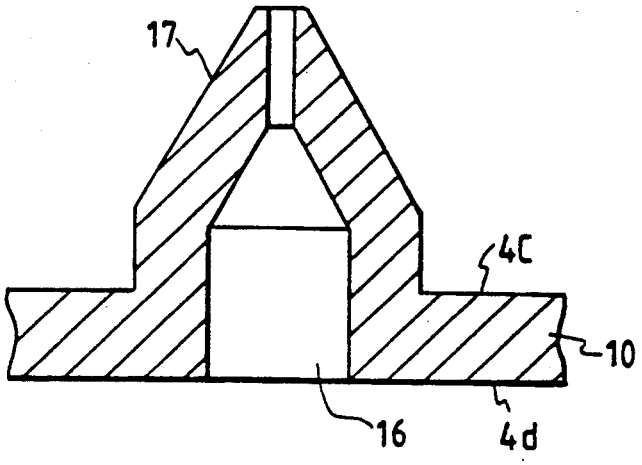
FIG. 10C is a view showing an example of sizes of a vent hole in a ventilation section according to the invention.

The applicant set dimensions as shown in FIG. 10C as an example of the vent hole and projection 17 in the ventilation chamber 7 shown in FIGS. 10A, 10B and 11. More specifically, the height of the projection 17 from the housing inner wall surface 4c was set to 3.0 mm, the height of a cylindrical stem portion of the projection 17 from the housing inner wall surface 4c to 0.9 mm, the height of a cylindrical inner surface of the projection 17 from the housing outer wall surface 4d to 1.7 mm, the height of an upper conical end of the inner bore surface of the projection 17 from the housing outer wall surface 4d to 2.75 mm, the outer diameter of the projection 17 to 2.9 mm, the outer diameter of the open end of the projection 17 to 0.5 mm, the inner diameter of the open end of the projection 17 to 0.3 mm, the diameter of the vent hole 16 to 1.5 mm, and the angle of taper to 30°.

While in this example the inner diameter of the open end 17A of the projection 17 was set to 0.3 mm, it is possible to select this dimension in a range of about 0.3 to 1.5 mm, preferably 0.3 to 0.8 mm. If the inner diameter is below the above-mentioned range, failure of steady ventilation is liable. If the inner diameter is above the above-mentioned range, on the other hand, leakage of ink is liable. The height of the projection 17 may be selected in a range of about 2.0 to 5.0 mm, and it suitably has the value shown in FIG. 10C for similar reasons. The angle of taper of the projection 17 need not be exactly 30° but may be substantially equal to this value.

Figure 10D:
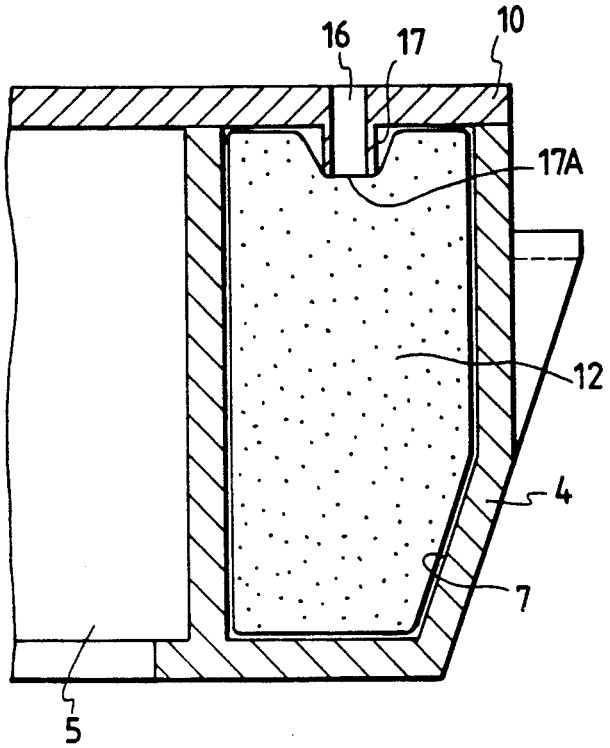
FIG. 10D is a sectional view showing a ventilation section in a further embodiment of the invention.

FIG. 10D shows a further embodiment of the invention. In this instance, a cylindrical, instead of conical, projection 17 projects from the back side of the lid 10 into the ventilation chamber 7. For the remainder of the structure, this embodiment is the same as the previous embodiment. This structure again permits wedging of the projection 17 into the porous member 12 with its open end 17A in forced contact with the member 12. It is thus possible to obtain the same ink leakage prevention effect.

In the above embodiments, the vent hole and projection surrounding the same are provided in and on the lid covering the ventilation chamber. However, it is of course possible to provide not the lid but any other wall than that of the ventilation chamber with a vent hole and a projection at suitable positions.

As noted above, the porous member 12 loaded in the ventilation chamber 7 has been treated to impart it with an ink-repellent property, so that it repels ink although it permits air flow through it. The porous member 14 has a lower ink charging efficiency but has a greater ink carrying property compared with the porous member 13. If the ink carrying capacity is excessive, however, a high negative pressure is generated on the side of the ink discharge section 2 to retard the re-charging of ink and reduce the response frequency of the head. Therefore, it is necessary to select a porous member having an adequate ink carrying capacity depending on the structure of the ink discharge port 9 and physical properties of ink.

Figure 12:
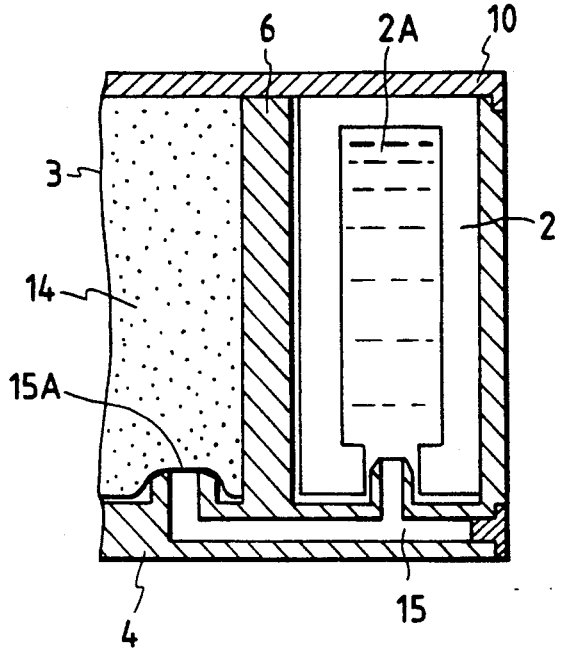

The porous member 14, as shown in FIG. 12, is loaded such that it is in forced contact with an ink tank side port 15A of an ink supply passage 15, which is formed in a portion of the housing bottom covering the ink tank 3 and unit accommodation section 5. Ink carried by the porous member 14 can be led through the ink supply passage 15 to an ink chamber 2A of the ink discharge unit 2.

As noted above and as shown in FIG. 11, the lid 10 has the vent hole 16. Therefore, even with the housing 4 sealed by the lid 10 secured thereto, the ink tank 3 can communicate with atmosphere via through the vent hole 16, ink-repulsive porous member 12 and communication hole 8.

Figure 13:
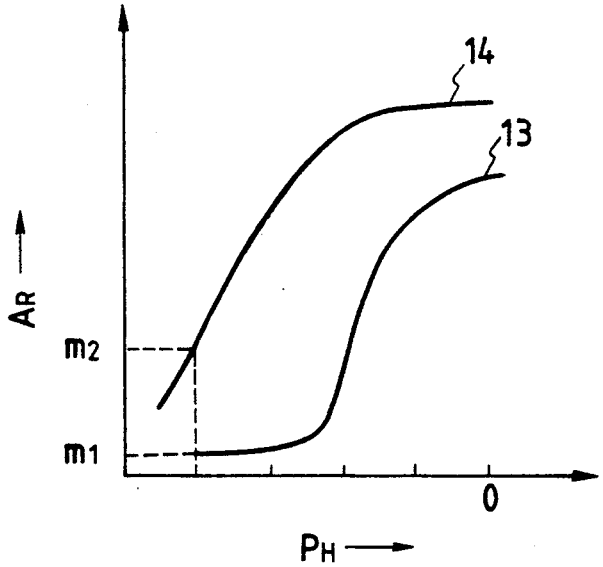
FIG. 13 is a graph showing ink carrying power of two different porous members according to the invention.

FIG. 13 compares the ink carrying characteristics of the porous members 13 and 14. The porous member 14 is smaller in non-independent pore diameter and lower in porosity than the porous member 13. Thus, it has stronger power of absorbing and carrying ink. When there is a head pressure P, therefore, the residual amount A of recording liquid or ink is greater with the porous member 14 than with the member 13. However, the porous member 13 has a higher ink carrying capacity per volume and has a character of permitting readier escape of ink from it. Therefore, ink can be more readily transferred from the porous member 13 to the member 14. Further, the ink carrying power of the porous member 14 is set such that replenishment of the ink chamber 2A after ink discharge can be effected without any problem.

With the ink jet recording head 1, ink can be carried with a sufficiently high ink charging efficiency by the porous member 13 which occupies a majority of the inner space of the ink tank 3. In this way, ink is stored. The stored ink is supplied to the ink chamber 2A of the ink discharge unit 2 as it is transferred to the porous member 14, which is higher ink carrying power even with the same ink head, and according to the discharge of ink. Owing to the presence of the porous member 14, air can never enter the ink supply passage 15 even when ink in the ink tank 3 is reduced. Further, where the ink jet recording head is mounted in a carriage of an ink jet recorder for recording as will be described later, it is possible to prevent ink in the ink tank from swinging and producing waves with vibrations of the carriage being moved. Further, air is taken into the ink tank 3 through the ink-repulsive porous member 12 accommodated in the ventilation space, ink will never leak to the outside when the posture of the recording head 1 is varied.

Figure 14A:
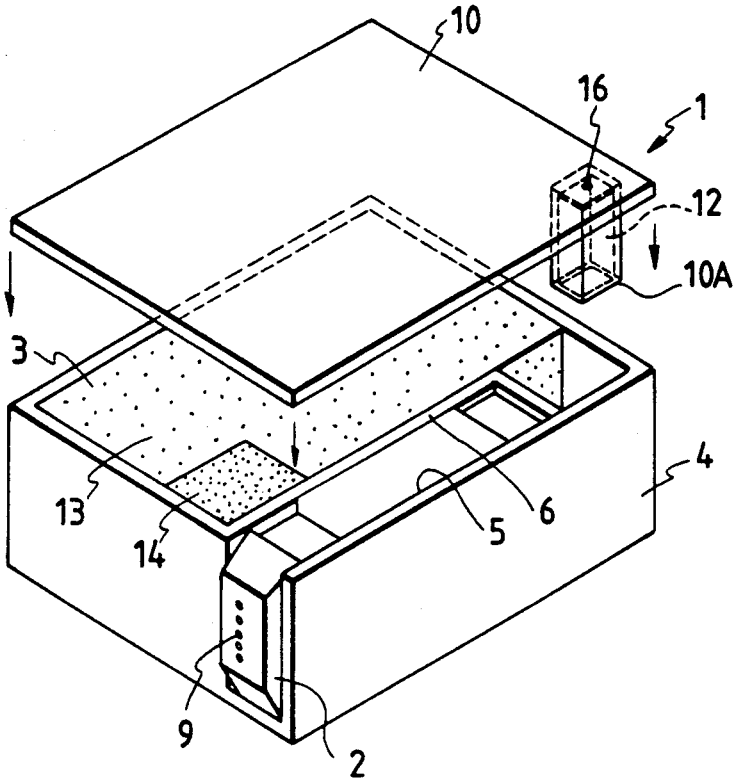
FIGS. 14A and 14B are an exploded perspective view and a fragmentary sectional view, respectively, showing a further embodiment of the invention.
Figure 14B:
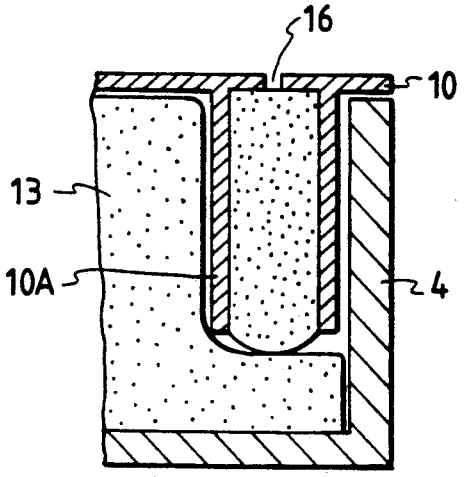

FIGS. 14A and 14B show a further embodiment of the invention. In this instance, no particular ventilation space is provided in the casing 4. Instead, a cylindrical holder 10A for holding the porous member 12 is provided on the under or inner side of the lid 10. The holder 10A with the porous member 12 therein is fitted in the ink tank 3. For the remainder of the structure, this embodiment is the same as the embodiment shown in FIG. 6A.

The ink-repellent porous material used in each of the above embodiment may be replaced with a felt-like fibrous member. More generally, any member may be used in lieu of the ink-repellent porous material so long as it has a ink-repulsive property or can be treated to impart it with an ink-repulsive property and can also ensure communication with atmosphere.

Figure 15A:
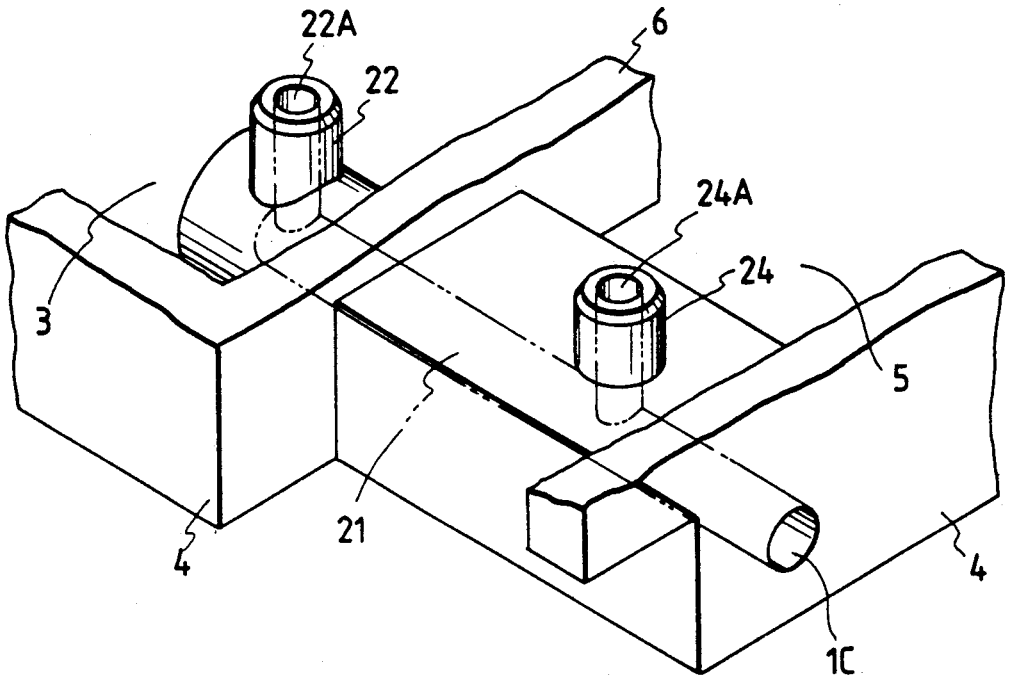
FIG. 15A is a fragmentary perspective view showing an ink passage and neighborhood thereof according to the invention.
Figure 15B:
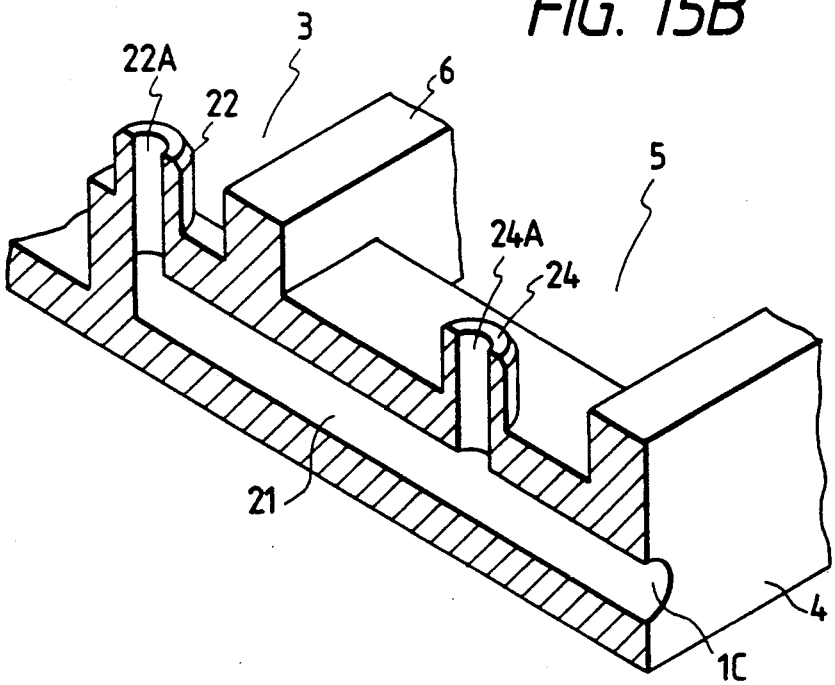
FIG. 15B is a perspective view showing a section of the structure shown in FIG. 15A.

An ink passage leading from the ink tank 3 to the ink discharge section 2 will now be described in detail with reference to FIGS. 15A, 15B and 16. In these Figures, reference numeral 21 designates the ink passage formed in the bottom of the housing 4. An ink supply port 22A open to the interior of the ink tank 3 (hereinafter referred to as ink tank side port) communicates with the ink supply passage 21. The ink tank side port 22A is defined by a hollow projection 22 with a conically tapered end.

The ink passage 21 has an ink charging port 1C at the other end. After ink has been charged into the recording head 1 from the ink charging port 1C in the manner as described later, the port 1C is closed by a ball 23 as shown in FIG. 16. Reference numeral 24 designates a hollow projection defining a head side port 24A and having a conically tapered end.

The ink discharge unit 2 is mounted on and positioned by the projection 24. The bottom of the ink discharge unit 2 is provided with an ink reception port 25, which is fitted on the projection 24. The unit 2 has a depressed portion 26 formed around the ink reception port 25. A seal member 27 is provided in the depressed portion 26 to prevent ink supplied from the ink tank 3 from leaking to the unit accommodation section 5. The ink discharge unit 2 is secured in position in the section 5 by a securing pawl 15. At this time, an urging force is applied in the direction of arrows B to the seal member 27 to cause deformation thereof. Thus, it is possible to obtain a sufficiently enhanced sealing effect.

Figure 16:
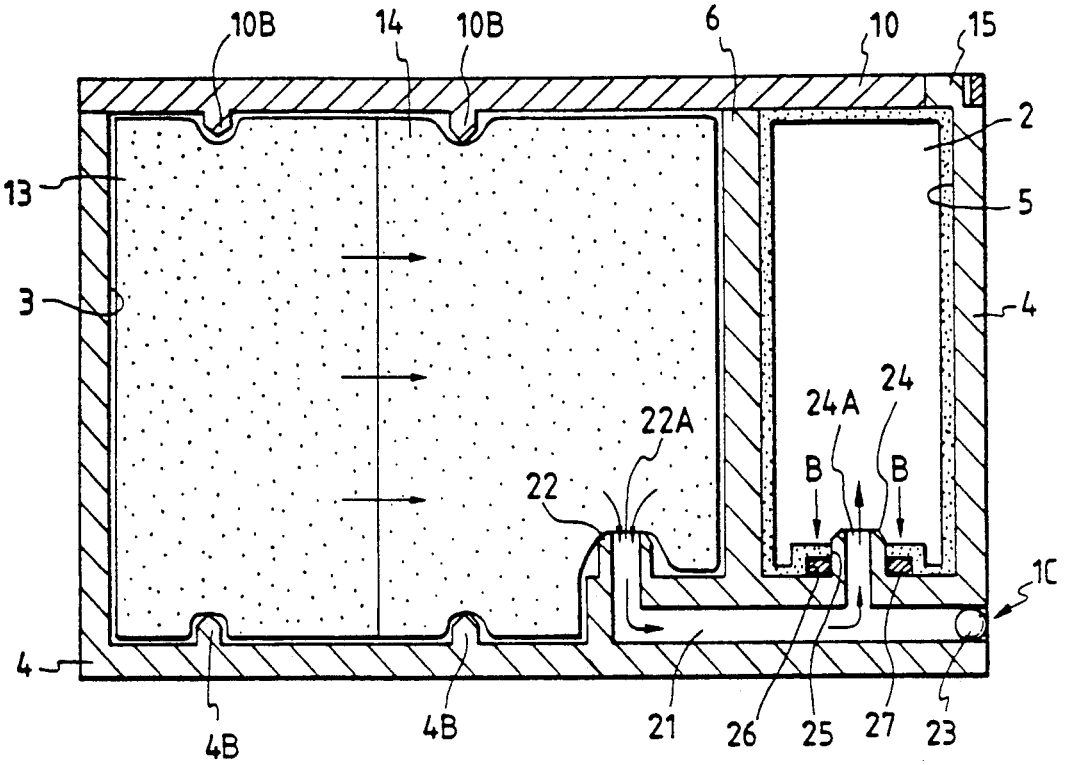
FIG. 16 is a view for explaining the operation of supplying ink through ink passage according to the invention.

A porous member 14 is sealed in the ink tank 3 such as to cover the ink tank side port 22A, and a porous member 13 is accommodated around the porous member 14 as shown in FIG. 16. The porous member 14 is smaller in the non-independent pore diameter and has a stronger power of absorbing and carrying ink compared to the porous member 13. The porous member 13, on the other hand, has a greater ink storage capacity but a lower ink carrying power than those of the porous member 14. Therefore, as ink is consumed in the ink discharge unit 2, ink carried by the porous member 13 is transferred to the porous member 14, and thence it is supplied through the port 22A, ink passage 21 and head side port 24A to the ink discharge unit 2.

The porous members 13 and 14 accommodated in the ink tank 3 are retained such that they are wedged by ribs 4B and 10B surrounding them. Besides, the ink tank side port 22A is open at the end of the projection 22 in close contact with the porous member 14. Therefore, it is possible to prevent bubbles from entering the ink discharge unit 2 after being led along the ink tank inner wall surface.

Figure 17A:
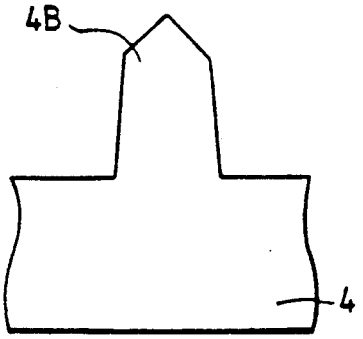
FIGS. 17A and 17B are views showing an example of rib sizes according to the invention.
Figure 17B:
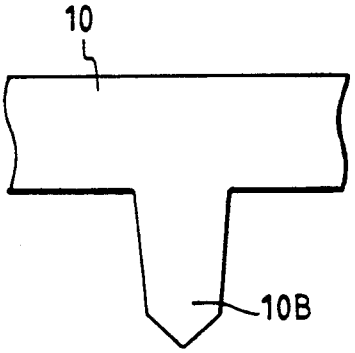

FIGS. 17A and 17B show an example of dimensions of the ribs 4B and 10B as set by the applicant. The edge angle may be selected in a range of 30° to 180°. If the edge angle is too large, the extent of wedging of the ribs into the porous members 13 and 14 is reduced, and the force of retaining the members 13 and 14 is reduced that much, thus reducing the force of preventing the flow of bubbles and ink. The heights and of the respective ribs 4B and 10B may be selected in a range of not less than about 1.0 to not more than 3.0 mm. If the height is excessively small, the wedging effect may be insufficient. If the height is excessively large, on the other hand, the porous members 13 and 14 are undesirably excessively deformed. The widths and of the respective ribs 4B and 10B may be selected in a range of not less than about 0.5 to not more than 1.5 mm. However, since the ribs also serve as reinforcement of plate, their widths are desirably about one-half to two-thirds of the respective housing thickness.

In the above embodiment, the ribs 4A and 10A each had an edge having a sharply pointed sectional profile as a suitable shape. However, this sectional profile is by no means limiting; for example, the edge may have a sectional profile consisting of a plurality of sharply pointed hills or a T- or L-shaped sectional profile. In general, the projecting section or rib edge may have any sectional profile so long as it can be in close contact in a wedging fashion with the porous member as ink carrier.

Figure 18:
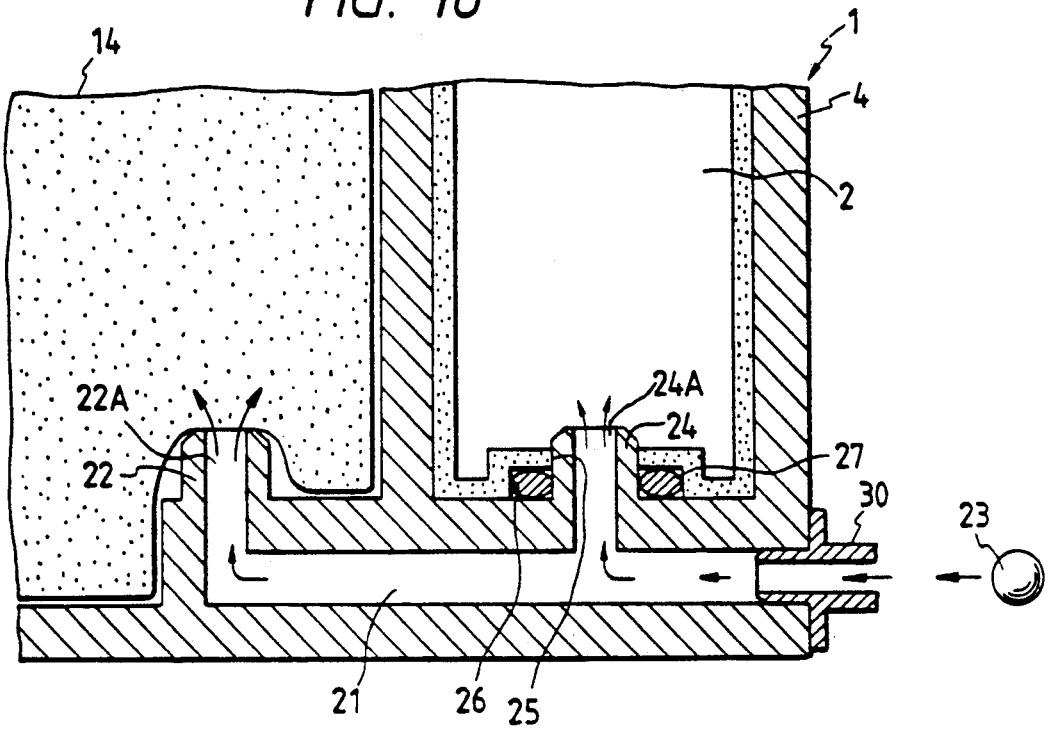
FIG. 18 is a view for explaining an operation of charging ink according to the invention.

The applicant set various dimensions as shown in FIG. 18 concerning the ink supply passage from the ink tank 3 to the ink discharge unit 2 and ink charging passage shown in FIG. 16. However, it is possible to set the inner diameters and of the respective ports 22A and 24A in a range not less than about 0.5 mm and nor more than about 1.5 mm, the height of the projection 22 in a range not less than about 1.0 mm and not more than about 3.0 mm, the height of the projection 24 in a range not less than about 1.5 and not more than about 4.0 mm, the distance between the ports in a range not less than about 7.0 mm and not more than about 20.0 mm and the diameter of the charging port 1C and charging passage communicating therewith in a range not less than about 0.5 mm and not more than about 2.5 mm.

The distance between the ports 22A and 24A is desirably as small as possible so long as it is permissible under design conditions from the standpoint of the resistance offered against flow. The corresponding distance between the ports 24A and 1C may be determined appropriately in relation to the ink discharge unit 2. The diameter of the ink passage 21 is set in a range not less than about 0.5 mm and not more than about 2.0 mm, and the diameter $\phi 5$ of the charging passage in a range not less than about 1.0 mm and not more than about 2.5 mm. However, the ink passage 21 is desirably as narrow as possible from the standpoint of alleviating the influence of vibrations. The charging passage and charging port, on the other hand, are desirably as wide as possible from the standpoint of readiness of charging of ink.

Now, the operation of charging ink into the recording head 1 will be described with reference to FIG. 18. The charging of ink is done after the recording head 1 has been assembled. More specifically, it is done after loading the porous members 13 and 14 in the ink tank 3 and the porous member 12 in the ventilation chamber 7, mounting the ink discharge unit 2 in the unit accommodation section 5 and mounting the lid 10 by means of ultrasonic welding.

In the first step of the operation, an ink injection pipe 30 is insertedly mounted in the ink charging port 1C, and ink is injected through this pipe 30. At this time, air in the ink discharge unit 2 is purged off to the outside through the ink discharge port 9 of the ink discharge unit (recording head section) shown in FIG. 3A. Further, ink is forced through the ink passage 21 into the ink tank 3. The ink entering the ink tank 3 progressively migrates into the porous members 14 and 13, while purging off air in the inside through the adjacent ventilation chamber 7 and vent hole 16 in the lid 10.

When sufficient ink is carried by the porous members 13 and 14, the ink injection pipe 30 is removed, and then the ball 23 is pressure fitted in the ink charging port 1C to prevent leakage of ink to the outside.

Figure 1A:
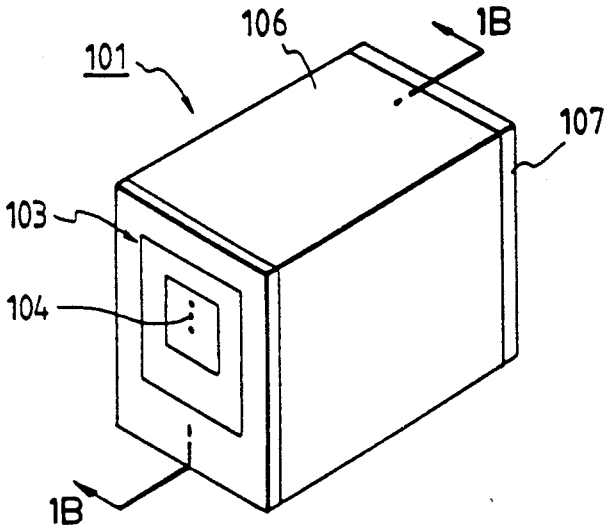
FIG. 1A PRIOR ART
FIGS. 1A and 1B schematically show a prior art ink jet recording head, with FIG. 1A being a perspective view and FIG. 1B being a schematic sectional view.
Figure 1B:
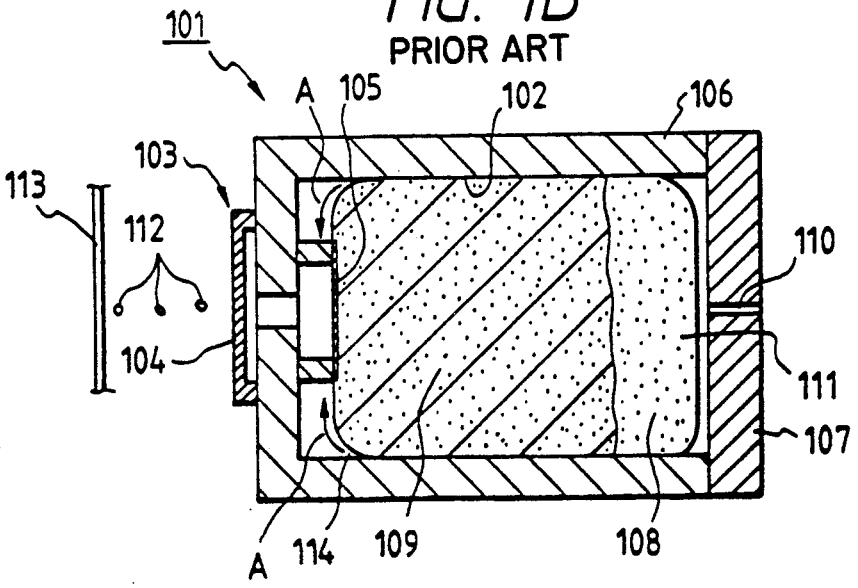
FIG. 1B PRIOR ART
Figure 2:
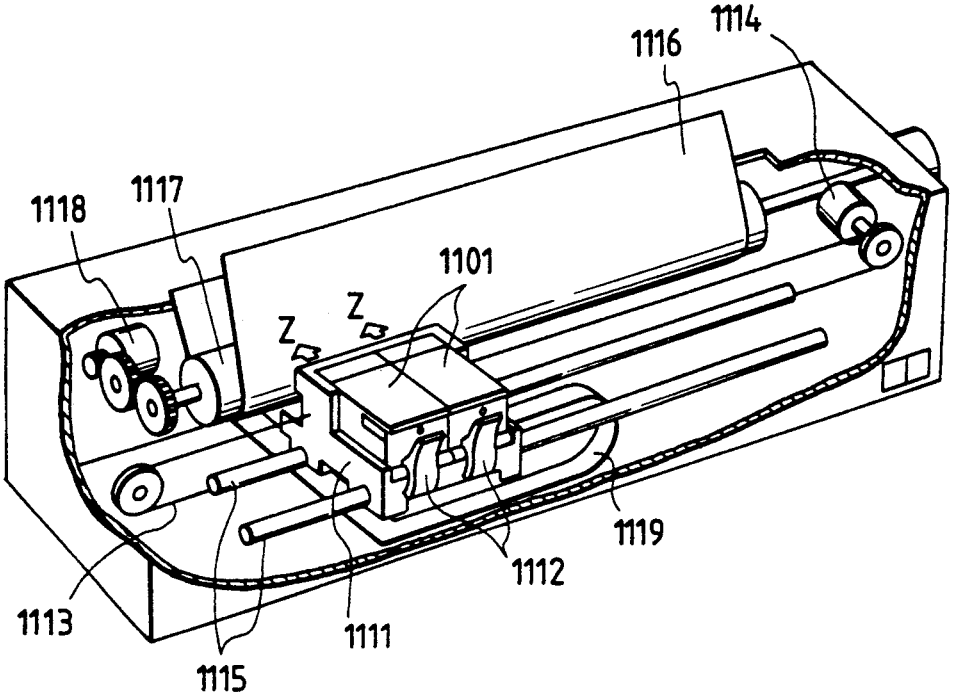
FIG. 2 is a schematic perspective view, partially broken apart, showing an ink jet recording apparatus with an ink jet recording head mounted therein.

FIG. 2 is a perspective view showing an ink jet recorder, in which each of the above embodiments of the recording head is mounted.

The recording head 1 is secured to the carriage 1111 by the keeping members 1112. With movement of the carriage 1111 along the guide bars 1115 the head 1 performs scanning of the recording sheet 1116 for recording. Meanwhile, the platen 1117 is driven for rotation by the motor 1118, thereby feeding the recording sheet 1116 held in close contact with it. A recording signal for ink discharge is supplied to the recording head 1 via the flexible wiring 1119 connected to the carriage 1111.

With the ink jet recording head 1 as described above, ink can be stored with a sufficiently high charging efficiency by the porous member 13 which occupies a major proportion of the inner space of the ink tank 3. This ink is transferred from the porous member 13 to the porous member 14 having a higher ink carrying power even with the same ink head and supplied to the ink discharge unit 2 according to the discharge of ink. The ink tank 3 is replenished with air through the vent hole 16 and ventilation chamber 7, and thus a constant ink tank inner pressure is held at all time, thus permitting the ink discharge unit 2 or recording head section to maintain an optimum ink discharge characteristic. Further, it is possible to prevent ink in the ink tank from swinging or producing waves due to vibrations or the like of the carriage produced as the carriage is moved. Further, air is taken into the ink tank 3 through the ink-repulsive porous member 12 accommodated in the ventilation chamber 7, while in the ventilation chamber 7 the vent hole 16 is open at the tip of the projection 17 projecting into the chamber 7, with the ink-repulsive porous member 12 in close contact in a wedging fashion with the open tip or end 17A, in the event if ink is caused to flow from the ink tank 3 through the communication hole 19 in the partitioning wall 17 shown in FIG. 3 into the ventilation chamber 7, it will never migrate into the porous member 12. Also, even if ink is caused to flow along the inner wall surface, it is blocked by the projection 17 and never leaks to the outside.

Still further, ink is charged into the ink tank 3 and ink discharge unit 2 by making use of the ink passage 21 after the recording head 1 has been assembled, since the ink passage 21 is formed such that it communicates the ink tank 3 and ink discharge unit 2 with each other, it is possible to charge ink into the both simultaneously and reliably, and there is need of providing any separate ink injection passage.

In a further aspect, in this ink jet recording head 1 the ink tank 3 is replenished with air through the ventilation chamber 7 as ink is consumed as noted before. The replenishment air is liable to be mixed as bubbles in ink with vibrations or shocks when mounting the recording head in the recorder or during movement of the carriage. Such air bubbles tend to be led to the ink discharge section or ventilation chamber 7 through a gap between the ink tank inner wall surface and porous members 13 and 14. However, as noted before, the ribs 4B and 10B provided on the inner surfaces of the walls of the housing 4 and lid 10 have their free edges wedging in the porous members 13 and 14 such as to prevent the flow of such air bubbles. It is thus possible to prevent imperfect discharge of ink due to otherwise possible mixing of air bubbles in the discharged ink.

Furthermore, since the porous members 13 and 14 are held in position by the ribs 4B and 10B in the state as described before, they are never displaced inside the ink tank but are stably held in predetermined positions even if slight vibrations or shocks are produced. Besides, the ribs 4B and 10B can increase the rigidity of the ink tank walls and partitioning wall 6 of the housing 4.

Figure 19:
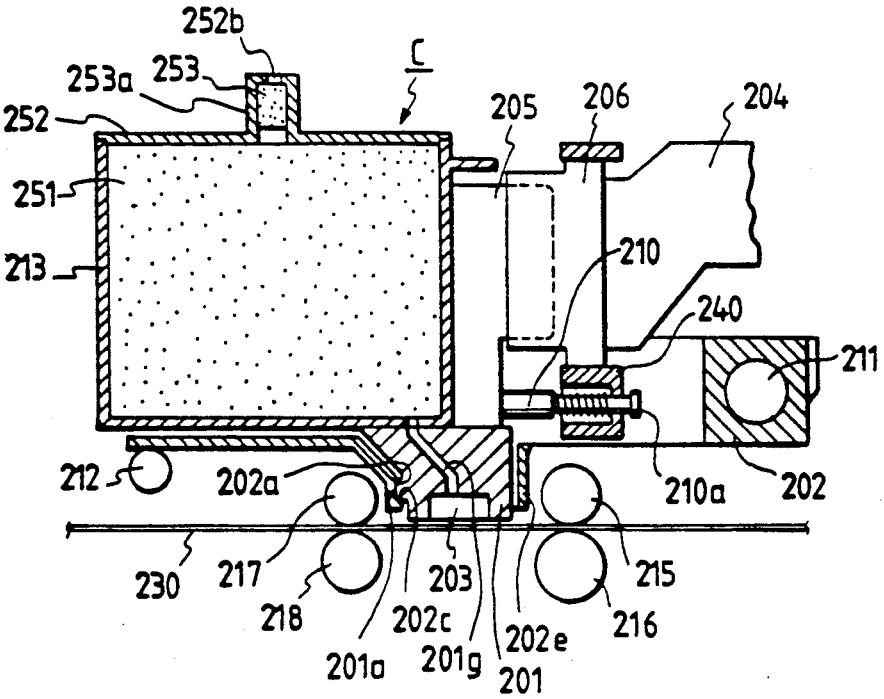
FIG. 19 is a schematic view showing a further embodiment of the invention applied to a recording head of a different type.

FIG. 19 shows a further embodiment of the ink jet recording head according to the invention. This recording head is a recording head cartridge, in which a recording head section and an ink tank are integral with each other.

Designated at C is the ink jet recording head cartridge provided with an ink discharge unit (or recording head section) 201. The cartridge C can be mounted on and dismounted from a carriage 202 slidably supported on an operating rail 211 and also on a slide rail 212. The carriage 202 can scan a recording medium 230 in a perpendicular direction thereto for recording image. With the scanning of the carriage 202 drops or particles of ink supplied from an ink tank 213 are jetted according to image information from a plurality of jet nozzles 203 of the recording head section 201, which has a plurality of electrothermal transducers (not shown) for forming ink drops or particles according to image information, whereby an image of characters or drawings is recorded on the recording medium 230. The recording medium 230 is fed by feed rollers 215 to 218 according to the process of the recording. The ink jet recording head cartridge C having the recording head section 201 and ink tank 213 can be mounted in the carriage 202.

The ink tank 213 accommodates a porous member or fibrous member 251, which carries charged ink. The member 251 can prevent easy movement of ink inside the cartridge even when the cartridge experiences vibrations or shocks, thus preventing leakage of ink or adverse effects on recording. Ink is supplied from the ink tank 213 through a passage 210*g* leading from the ink tank bottom to the jet nozzles 203, and ink drops are selectively jetted against the recording medium 230 for recording of image according to an image recording signal supplied from the recorder side to a head connector 205.

A lid 252 is secured to the ink tank 213 in a sealing fashion to prevent leakage of ink. The lid 252 has a hollow projection 252*a* projecting above the ink tank top and accommodating an ink-repulsive member 253. The ink-repulsive member consists of a porous or fibrous material having an ink-repulsive property, that is, it repels ink while permitting passage of air through it without offering resistance. The projection 252*a* has a vent hole 252*b* formed at the upper end. External air is led into the ink tank 213 through the vent hole 252*b* as residual ink is reduced with supply of ink. However, since the neighborhood of the vent hole 252*b* is sealed against ink by the ink-repulsive member 253, ink in the inside will never leak to the outside through the vent hole 252*b*. It is of course possible to load a plurality of different porous materials having different ink carrying factors in the ink tank.

Figure 20:
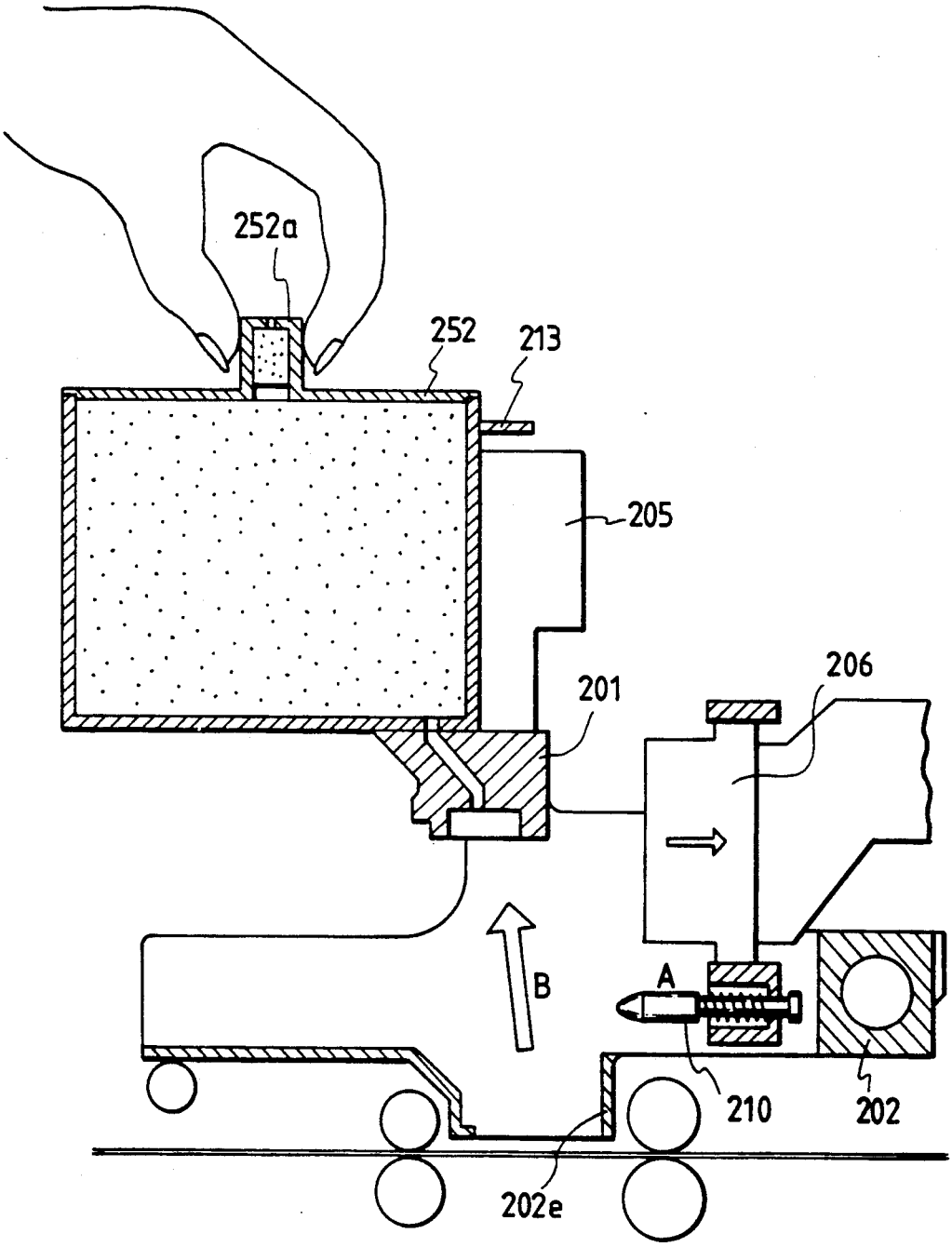
FIG. 20 is a view showing the recording head of FIG. 19 in a released state.

FIG. 20 shows details of the embodiment when the recording head section 201 is released.

In the released state of the recording head section 201, the connector holder 240 is moved to the right (i.e., in the direction of arrow A). At this time of movement, the recording head section 201 strikes a guide 202*e* to stop movement. As a result, a recorder side connector 206 and a head connector 205 are separated from each other to release urging force applied to the recording head section 201. The recording head section 201 is thus released from its positioned state.

When the head connector 205 of the recording head section 201 and recorder side connector 206 are separated and also a push pin 210 is separated from the recording head section 201, the recording head can be raised in the direction of arrow B by holding a projection 213*a* projecting from the top of the ink tank 213.

Figure 21:
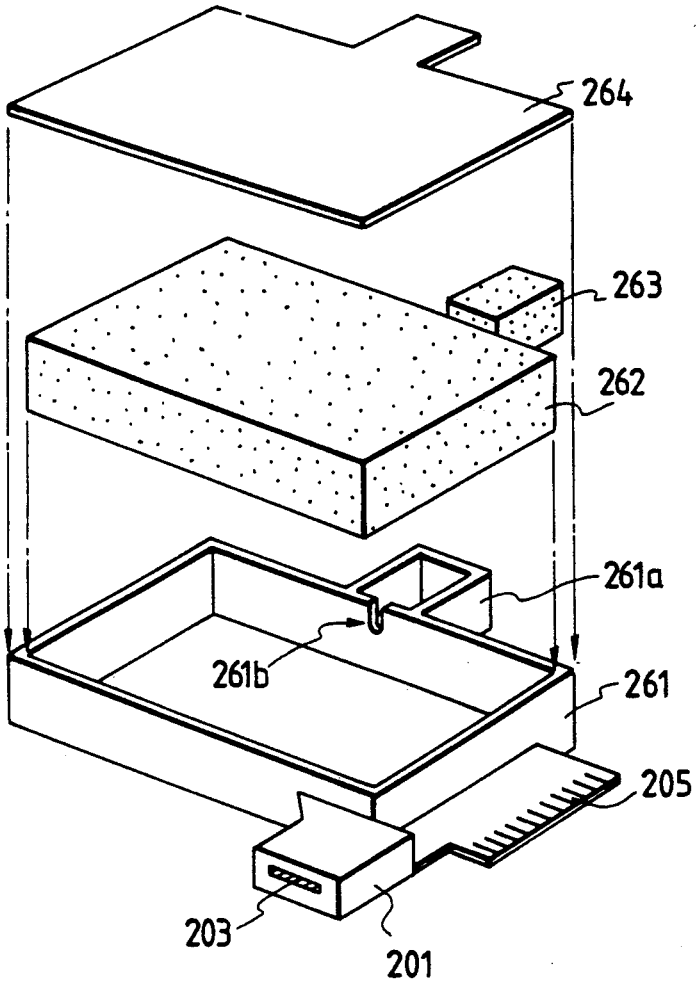
FIG. 21 is an exploded perspective view showing a further embodiment of the invention applied to a cartridge structure of recording head.

FIG. 21 shows a different embodiment of the cartridge structure. In this example, an ink tank 261 and a lid 264 can be separated from each other. Thus, an ink carrying member 262 and an ink-repulsive member 263 can be readily inserted in their thickness direction into the ink tank 261 and a projection 261*a*. Thus, an improved assembling property can be obtained.

Figure 22:
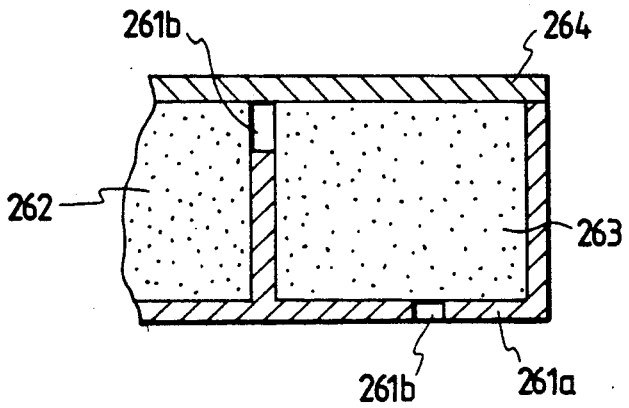
FIG. 22 is a fragmentary sectional view, to an enlarged scale, showing a projection shown in FIG. 21.

FIG. 22 is a fragmentary sectional view showing the projection 261*a*. Air is supplied into the ink tank through a vent hole 261*b* as air-communication section, the ink-repellent member in the projection and a communication groove leading to the ink tank. The ink-repellent member 263 is urged against the vent hole 261*b*, thus preventing ink from leaking to the outside of the ink tank.

By disposing the ink-repellent member 253 in the projection of the cartridge C in the above way, it is possible to make effective use of the space in the cartridge and realize a small size cartridge. Further, an improved ink leakage prevention effect can be obtained by providing an ink-repellent member and a vent hole in a projection which is found above an ink storage section at the top of an ink tank.

Further, by disposing an ink-repellent member in a projection as a depressed portion of a lid, it is possible to improve seal against leakage of ink through a vent hole which is formed in the bottom of the depressed portion. In this case, it is possible to readily prevent leakage of ink.

Further, since the ink carrying member and ink-repellent member may have rectangular shapes, they can be readily loaded, and an improved assembling property can be obtained.

Furthermore, by arranging such that an ink-repellent member is loaded in a small section in the inside of a projection of cartridge, it is possible to obtain improved close contactness between the ink-repellent member and inner wall surface of the small section and hence improved ink leakage prevention effect and also provide a cartridge which can be readily manufactured on a mass production basis.

In the above embodiments and examples, an ink-repulsive member having an ink-repellent character is loaded in a ventilation chamber provided with a vent hole.

However, it is possible to dispense with the ink-repellent member in the ventilation chamber by providing a wall between the ventilation chamber and ink storage section as shown in FIGS. 6A, 10A, 10B and 21 and forming a communication hole (19, 261*b*) in the wall. Doing so provides the ventilation chamber with a function as a buffer section between the ink storage section and atmosphere.

The communication hole (19, 261*b*) may have a size of about 22 mm by about 8 mm. In this case, normally ink is carried with high carrying force by the ink carrier loaded in the ink storage section, so that it never flows into the ventilation chamber.

Even if ink flows into the ventilation chamber due to such cause as external vibrations or high temperature, it is collected in the ventilation chamber and readily returned to the ink storage section through the large communication hole (19, 261*b*).

Further, since the ventilation chamber as a buffer room has a smaller volume than the ink storage section, if ink enters the ventilation chamber, it will be readily returned to the ink storage section without being collected in the ventilation chamber.

If necessary, a repellent filter may be provided in the communication hole.

Furthermore, by providing the buffer room in the ink tank it is possible to obtain an effect of highly satisfactory suppression of evaporation of ink with a thermal change caused by heat generated from the recording head.

Moreover, the buffer chamber can also satisfactorily suppress evaporation of ink caused by environmental changes.

The present invention provides particularly excellent effects when it is applied to a recording head and a recorder of a bubble jet system among ink jet recording systems.

The typical construction and principle of this system are disclosed in U.S. Pat. Nos. 4,723,129 and 4,740,796. While this system is applicable to either of commonly termed on-demand type and continuous type, it can be particularly effectively applied to the on-demand type. In the on-demand type, an electrothermal transducer is provided in correspondence to a sheet or passage, in which ink or like liquid is carried. To the electrothermal transducer is applied at least one drive signal, which corresponds to recording information and provides a sudden temperature rise to cause nuclear boiling. As a result, heat energy is produced in the electrothermal transducer to cause membraneous boiling on a heat-acted surface of the recording head, thus producing bubbles in ink in one-to-one correspondence to the drive signal. A sudden pressure change produced with growth and contraction of the bubble is utilized to cause discharge of ink through the ink discharge port so as to form at least one ink drop. By supplying a pulse signal as drive signal, instantaneous and adequate growth and contraction of bubbles can be obtained to attain discharge of ink excellent in response. A suitable example of the pulse signal as drive signal is disclosed in U.S. Pat. Nos. 4,463,359 and 4,345,262. Further, more excellent recording can be realized by adopting conditions described in U.S. Pat. No. 4,313,124 concerning the rate of temperature rise of the heat-acted surface noted above.

As the structure of the recording head according to the invention, in addition to the combination of an ink discharge port, an ink passage and an electrothermal transducer as described above (having either a straight ink passage or an orthogonal ink passage), there are those in which a heat-acted section is disposed in a bent area as disclosed in U.S. Pat. Nos. 4,558,333 and 4,459,600. Further, the invention can be effectively applied to a structure, in which discharge sections of a plurality of electrothermal transducers are constituted by a common slit as disclosed in Japanese Patent Laid-open No. 59-123670, and also to a structure, in which an opening for absorbing pressure waves of heat energy corresponds to a discharge section as disclosed in Japanese Patent Laid-open No. 59-138461.

Further, as a recording head of full line type having a length corresponding to the maximum recording medium width, over which recording may be made by the recorder, there may be one, which meets the length noted above with a combination of a plurality of recording heads as disclosed in the specifications noted above, or one having a structure as a single and integral recording head. In case of such recording heads, the effects of the invention as noted before can be obtained more effectively. Further, the invention can be effectively applied to a replaceable recording head of chip type, which can be electrically connected to the recorder and also can be supplied with ink from the recorder when it is mounted in the recorder, or a recording head of cartridge type.

Further, the effects of the invention may be promoted by adding recording head recovery means and various spare means that are provided as components of a recorder. Specific examples of these additional means with respect to the recording head are capping means, cleaning means, pressure application means or sucking means, electrothermal transducers or heating elements separate therefrom, preliminarily heating means as combinations of such electrothermal transducers and heating elements and preliminary ink discharge means for permitting discharge of ink independently of recording. These means are effective for ensuring stable recording. Further, the invention is very effective when applied to a recording apparatus, which does not only have a main black color recording mode but also have other color recording modes, for instance a multi-color recording mode using a plurality of different colors provided by a single recording head or a combination of a plurality of recording heads.

More excellent effects may be obtained by providing the ink tank inner wall surface with a plurality of ribs.

By providing ribs, it is possible to prevent ink from being led along the ink tank inner wall surface to enter the ink supply port and also permit uniform consumption of ink carried by the ink carrier.

As has been described in the foregoing, according to the invention it is possible to provide an ink tank, which has a high ink charging efficiency, is free from leakage of ink through a vent hole during its handling or due to vibrations or shocks, is highly reliable and can be used conveniently.

Also, it is possible to provide an ink tank, which can prevent bubbles from being led along its inner wall surface to an ink discharge section.

Further, ink carried by an ink carrier can not reach the vent hole owing to the presence of an ink-repellent material, so that there is no possibility of clogging of the vent hole by dried ink attached thereto.

Therefore, it is possible to provide an ink tank, which ensures communication with atmosphere and is free from leakage of ink from the vent hole, thus eliminating contamination of the recorder or recording medium with leaking ink.

Further, according to the invention the ink storage section is communicated with atmosphere via a ventilation chamber, in which an ink-repellent porous material is loaded. Thus, it is possible to provide an ink jet recording head, which is free from leakage of ink or like recording liquid in an ink storage section to the outside even when it experiences vibrations or shocks or is suddenly moved.

Further, according to the invention a projection defining a vent hole communication with atmosphere projects into a ventilation chamber with the vent hole at the end of the projection held in contact with an ink-repellent porous member. Therefore, even if ink enters the ventilation chamber and is led along the inner wall surface thereof to reach the neighborhood of the vent hole, it never leaks through the vent hole to the outside for the vent hole is formed in the projection, the end of which is in forced contact with the ink-repellent porous member. It is thus possible to provide an ink jet recording head, which will never contaminate the recorder or hands and clothes of the operator, is highly reliable and can be used conveniently.

Further, according to the invention ink can be carried with a high charging efficiency by a porous member having a high ink charging efficiency, which occupies a major portion of the space of an ink storage section. In addition, ink can be supplied to the ink discharge section through an ink supply passage without possibility of withdrawing air through a porous member having a rich ink retaining property. Further, since air is allowed to flow into the ink storage section through a porous member having an excellent ink-repellent character, ink will never leaks through the vent hole due to vibrations or movement of the recording head.

Further, according to the invention applied to an ink jet recording head, in which a recording head section and an ink storage section are provided integrally in a housing, a porous member having ink-repellent property and air permeability is provided in contact with a vent hole communicating with a section, in which the recording head section is accommodated. In addition, a porous member having low porosity and hence high ink carrying capability is provided in contact with an ink supply port of an ink supply passage leading from the ink storage section to the recording head section and open to the ink storage section. Further, a porous member different from the afore-mentioned porous member and having a higher porosity and a higher ink charging factor is provided to occupy a major portion of the rest of the space in the ink storage section. Thus, it is possible to provide a highly reliable, small size ink jet recording head, which can store a sufficient amount of ink in the ink storage section despite of its compact and integral type construction and is free from leakage of ink when it experiences vibrations or the like.

Further, according to the invention the inner wall surface of the ink storage section is provided with a plurality of ribs such that the edges of these ribs are in contact with the ink carrier, thus dividing the space formed between the ink storage section inner wall surface and ink carrier. Thus, it is possible to prevent air bubbles or the like in ink from being led along the space noted above to the recording head section and interfering with the discharge of ink and also prevent leakage of ink to the outside. In addition, there is possibility of preventing defective or instable ink discharge that may otherwise occur due to introduction of air bubbles in ink. Further, the ink carrying capacity is never influenced. Further, the rigidity of the walls of the ink storage section is enhanced to eliminate leakage of ink due to otherwise possible deformation of the walls. Further, the ink carrier is stably held in position by the ribs and is never displaced due to vibrations or shocks.

Further, according to the invention the effects of a cartridge type recording head, which includes a recording head section for discharging ink and an ink tank accommodating a porous material or a fibrous material, can be enhanced by providing a projection on the cartridge. In addition, by loading an ink-repellent member in a small room formed in the projection, an improved close contact between the ink-repellent member and small room inner wall surface can be obtained. Thus, it is possible to provide a cartridge, which can improve the ink leakage prevention effect and has excellent mass production property.

Further, according to the invention an ink supply passage for supplying ink from the ink storage section to the recording head section is provided with an ink injection passage communicating with it and capable of being sealed, thus permitting charging of ink into the ink storage section and recording head section from the ink injection passage through the ink supply passage. Thus, there is no need of providing any separate ink injection passage for charging ink, thus permitting simplification of the construction and charging of ink in short time.

Further, according to the invention it is possible to provide an ink jet recording apparatus with an ink jet recording head, which has various excellent properties as described above such as having a high ink charging factor, being free from leakage of ink through the vent hole during handling or due to vibrations or shocks and preventing air bubbles from being led along the ink tank inner wall surface to the ink discharge section, thus eliminating defective or instable discharge of ink.

What is claimed is:

1. An ink tank for storing ink, comprising:

an ink storage section including an ink containing member for containing ink, said ink containing member being provided over substantially the entire range of an ink storage area of said ink storage section; and a ventilation section having a vent hole communicating the interior of said ink tank with atmospheric air, and an ink-repellent member for repelling said ink, wherein said containing member in said ink tank comprises first and second ink containing members, said second ink containing member for carrying ink and having a high porosity and said first ink containing member having a lower porosity than that of said second ink containing member, said ink-repellent member, said second ink containing member and said first ink containing member being accommodated in the mentioned order from the side of said vent hole communicating the inner space of said ink tank with atmospheric air to the side of an ink supply passage for supplying ink to a recording head.

2. An ink tank according to claim 1, wherein said first and second ink containing members are porous or fibrous members.

3. An ink jet recording head comprising:

an ink jet recording head section including an ink discharge port for discharging ink, an ink passage communicating with said ink discharge port and an energy generation element for generating energy utilized for the discharge of ink; and an ink storage section including an ink holding member for holding ink to be supplied to said ink jet recording section, said ink storage section having a vent hole communicating with atmospheric air, said ink holding member substantially entirely occupying an ink storage space and consisting of a first ink holding member and a second ink holding member, said first ink holding member having a lower porosity and a higher ink holding force than those of said second ink holding member, said first and second ink holding members being disposed in the mentioned order from the side of an ink supply passage for supplying ink from said ink storage section to said ink jet recording head section.

4. An ink jet recording head according to claim 3, wherein a portion surrounding said vent hole projects into a ventilation section and has a leading end in contact with an ink-repellent member.

5. An ink jet recording head according to claim 3, wherein said ink holding members are loaded in said ink storage section.

6. An ink jet recording head according to claim 5, wherein said ink holding members are a porous or fibrous member.

7. An ink jet recording head according to claim 3, wherein said ink-repellent member is a porous or fibrous member having an ink-repellent character or treated to be ink-repellent.

8. An ink jet recording head according to claim 3, wherein said ink storage section has an ink supply port for supplying ink to said ink jet recording head section, said ink supply port being constituted by a projection projecting into said ink storage section and having an end in contact with one of said ink holding members loaded in said ink storage section.

9. An ink jet recording head according to claim 3, wherein said energy generation element is an electrothermal transducer for generating heat energy utilized for the discharge of ink, a sudden pressure change being produced by air bubbles formed by said heat energy and being utilized for the discharge of ink.

10. In combination in an ink jet recording apparatus, a carriage and an ink jet recording head, said carriage scanning said ink jet recording head in a main scanning direction according to a recording signal, said ink jet recording head comprising:

an ink jet recording head section including an ink discharge port for discharging ink, an ink passage communicating with said ink discharge port and an energy generation element for generating energy utilized for the discharge of ink; and an ink storage section including an ink holding member for holding ink to be supplied to said ink jet recording section, said ink holding member substantially entirely occupying an ink storage space and being comprised of a first ink holding member and a second ink holding member, said first ink holding member having a lower porosity and a higher ink holding force than those of said second ink holding member, said first and second ink holding members being disposed in the mentioned order from the side of an ink supply passage for supplying ink from said ink storage section to said ink jet recording head section.

11. In the combination of claim 10, wherein said energy generation element is an electrothermal transducer for generating head energy utilized for the discharge of ink, a sudden pressure change being produced by air bubbles formed by said heat energy and being utilized for the discharge of ink.

12. An ink jet recording head comprising:

an ink jet recording head section including an ink discharge port for discharging ink, an ink passage communicating with said ink discharge port and an energy generation element for generating energy utilized for the discharge of ink; and an ink storage section for storing ink to be supplied to said ink jet recording head section, said ink storage section including an ink-repellent member repellent to ink provided in contact with a vent hole and an ink holding member provided on the side of an ink supply port for holding ink, said ink holding member substantially entirely occupying an ink storage space, wherein said ink holding member comprises a first ink holding member and a second ink holding member, said first ink holding member having a lower porosity and a higher ink holding force than those of said second ink holding member, said first and second ink holding members being disposed in the mentioned order from the side of an ink supply passage for supplying ink from said ink storage section to said ink jet recording head section.

13. An ink jet recording head comprising:

an ink jet recording head section including an ink discharge port for discharging ink, an ink passage communicating with said ink discharge port and an energy generation element for generating energy utilized for the discharge of ink; and an ink storage section for storing ink to be supplied to said ink jet recording head section, said ink storage section accommodating an ink-repellent member repellent to ink, a second ink holding member having a high porosity for carrying ink and a first ink holding member having a lower porosity than that of said second ink holding member, said ink-repellent member, second ink holding member and first ink holding member being disposed in the mentioned order from the side of a vent hole communicating the interior of said ink storage section with atmospheric air to an ink supply passage leading to said ink jet recording head, said first ink holding member being in contact with said ink supply passage.

14. An ink jet recording head according to claim 13, wherein a projecting portion surrounds said vent hole, projects into a ventilation section and has a leading end in contact with said ink-repellent member.

15. An ink jet recording head according to claim 13, wherein said ink holding members are a porous or fibrous members.

16. An ink jet recording head according to claim 13, wherein said ink-repellent member is a porous or fibrous member having an ink-repellent character or treated to be repellent to ink.

17. An ink jet recording head according to claim 13, wherein said ink storage section has an ink supply port for supplying ink to said ink jet recording head section, said ink supply port being constituted by a projection projecting into said ink storage section and having an end in contact with said ink holding members loaded in said ink storage section.

18. An ink jet recording head according to claim 13, wherein said energy generation element is an electrothermal transducer for generating heat energy utilized for the discharge of ink, a sudden pressure change being produced by air bubbles formed by said heat energy and being utilized for the discharge of ink.

19. In combination in an ink jet recording apparatus, a carriage and an ink jet recording head, said carriage scanning said ink jet recording head in a main scanning direction according to a recording signal, said ink jet recording head comprising:

an ink jet recording head section including an ink discharge port for discharging ink, an ink passage communicating with said ink discharge port and an energy generation element for generating energy utilized for the discharge of ink; and an ink storage section for storing ink to be supplied to said ink jet recording head section, said ink storage section accommodating an ink-repellent member repellent to ink, a second ink holding member having a high porosity for carrying ink and a first ink holding member having a lower porosity than that of said second ink holding member, said ink-repellent member, second ink holding member and first ink holding member being disposed in the mentioned order from the side of a vent hole communicating the interior of said ink storage section with atmosphere to an ink supply passage leading to said ink jet recording head section, said first ink holding member being in contact with said ink supply passage.

20. In the combinations of to claim 19, wherein said energy generation element is an electrothermal transducer for generating heat energy utilized for the discharge of ink, a sudden pressure change being produced by air bubbles formed by said heat energy and being utilized for the discharge of ink.

21. An ink jet recording apparatus according to claim 19, wherein said ink storage section has an inner wall surface, said inner wall surface being provided with a rib continuously extending along the periphery thereof.

22. An ink jet recording apparatus according to claim 21, wherein said inner wall surface and said holding members define a space therebetween, said rib divides said space between said inner wall surface and said ink holding members into two divisions, one of said divisions adjacent said ink supply port and the other adjacent said vent hole.

23. An ink jet recording head comprising:

an ink jet recording head section including an ink discharge port for discharging ink, an ink passage communicating with said ink discharge port and an energy generation element for generating energy utilized for the discharge of ink; and an ink storage section including an ink holding member for carrying ink, said ink holding member substantially entirely occupying an ink storage section, an ink supply port with ink being supplied therefrom to said ink jet recording head section and a vent hole communicating with atmosphere, said ink storage section having an inner wall surface, said inner wall surface and said ink holding member defining a space therebetween, said inner wall surface being provided with a rib in contact with said ink holding member, said rib extending along the entire periphery of said inner wall surface to divide said space between said inner wall surface and said ink holding member into two divisions, one of said divisions adjacent said vent hole.

24. An ink jet recording head according to claim 23, wherein a projecting portion surrounds said vent hole, projects into a ventilation section and has a leading end in contact with an ink-repellent member.

25. An ink jet recording head according to claim 24, wherein said ink-repellent member is a porous or fibrous member having an ink-repellent character or treated to be repellent to ink.

26. An ink jet recording head according to claim 23, wherein said ink holding member is a porous or fibrous member.

27. An ink jet recording head according to claim 23, wherein said ink supply port of said ink storage section comprises a projection projecting into said ink storage section and has an end in contact with the ink holding member loaded in said ink storage section.

28. An ink jet recording head according to claim 23, wherein said energy generation element is an electrothermal transducer for generating heat energy utilized for the discharge of ink, a sudden pressure change being produced by air bubbles formed by said heat energy and being utilized for the discharge of ink.

29. In combination in an ink jet recording apparatus, an ink jet recording head and a carriage, said carriage scanning said ink jet recording head in a main scanning direction according to a recording signal, said ink jet recording head comprising:

an ink jet recording head section including an ink discharge port for discharge ink, an ink passage communicating with said ink discharge port and an energy generation element for generating energy utilized for the discharge of ink; and an ink storage section including an ink holding member for holding ink, said ink holding member substantially entirely occupying an ink storage region, an ink supply port with ink being supplied therefrom to said ink jet recording head section and a vent hole communicating with atmosphere, said ink storage section having an inner wall surface, said inner wall surface and said ink holding member defining a space therebetween, said inner wall surface being provided with a rib in contact with said ink holding member, said rib extending along the entire periphery of said inner wall surface to divide said space between said inner wall surface and said ink holding member into two divisions, one of said divisions adjacent said ink supply port and the other adjacent said vent hole.

30. An ink jet recording apparatus according to claim 29, wherein said energy generation element is an electrothermal transducer for generating heat energy utilized for the discharge of ink, a sudden pressure change being produced by air bubbles formed by said heat energy and being utilized for the discharge of ink.

31. An ink jet recording head comprising:

a recording head section for discharging ink;

an ink holding section for holding ink, the interior area of said ink holding section being provided with an ink holding member of a porous or fibrous material; and a vent chamber communicating with said ink holding section and having a vent hole for communicating with the atmosphere, said vent hole being formed by a cylindrical member projecting into said vent chamber, wherein said vent chamber and said ink holding section are separated by a partition wall having a communication hole for maintaining an atmosphere communicating state in the interior of said ink holding section.

32. An ink jet recording head according to claim 31, wherein a repellant member of porous or fibrous material is provided in said vent chamber and the end of said cylindrical member which projects into said vent chamber contacts and presses said repellant member.

33. An ink jet recording head according to claim 31, wherein said vent chamber is a space of a smaller volume than that of said ink holding section.

34. An ink jet recording head according to claim 31, wherein the end of said cylindrical member has a converged and conical shape.

35. An ink jet recording head comprising:

an ink jet recording head section for discharging ink;

an ink storage section for storing said ink, said ink storing section including an ink holding member substantially entirely occupying the inner space and consisting of a porous or fibrous material; and a ventilation section communicating with said ink storage section and having a vent hole communicating with atmospheric air, said ventilation section and ink storage section being made discrete from each other by a wall having a communication hole for maintaining communication of the interior of said ink storage section with atmospheric air, wherein said ink holding member consists of a first ink holding member and a second ink holding member, said first ink holding member having a lower porosity and a higher ink holding force than those of said second ink holding member, said first and second ink holding members being disposed in the mentioned order from the side of an ink supply passage leading from said ink storage section to said ink jet recording head section.

36. An ink jet recording head comprising:

an ink jet recording head section having a discharge port for discharging ink and an energy generating element provided correspondingly to said discharge port for generating energy utilized for discharging ink;

an ink containing section for containing ink to be supplied to said recording head section, said containing section having a vent hole for causing the interior of said ink containing section to communicate with atmosphere;

an ink supply path communicating said recording head section with said ink containing section to supply ink to said recording head section;

an ink injection path for supplying ink from outside said recording head to said ink containing section, said ink injection path communicating with said ink supply path, and said ink supply path forming a part of said ink injection path; and a sealing member for sealing an injection opening of said ink injection path.

37. An ink jet recording head according to claim 36, wherein said ink jet recording head is removably attached to a recording apparatus.

38. An ink jet recording head capable of being replenished with ink, said ink jet recording head comprising:

a recording head section having a discharge port for discharging ink and an energy generating element provided correspondingly to said discharge port for generating energy utilized for discharging ink;

an ink containing section for containing ink to be supplied to said recording head section;

an ink supply path communicating said recording head section with said ink containing section to supply ink to said recording head section; and an ink injection path for supplying ink from outside said recording head to said ink containing section, said ink injection path communicating with said ink supply path, and said ink supply path forming a part of said ink injection path, wherein to replenish ink through said ink injection path, replenishment ink is injected to said recording head section and to said containing section and the flow of replenishment ink to said containing section flows through a part of said ink supply path, and wherein after replenishing ink to said recording head section and said ink containing section, said ink injection path is closed by a sealing member.

39. An ink jet recording head according to claim 36, wherein said energy generation element is an electrothermal transducer for generating heat energy utilized for the discharge of ink, a sudden pressure change being produced by air bubbles formed by said heat energy and being utilized for the discharge ink. heat energy and being utilized for the discharge ink.

40. An ink jet recording head according to claim 38, wherein said ink jet recording head is removably attached to a recording apparatus.

41. An ink jet head cartridge comprising:

a recording head section having a discharge port for discharging ink, an ink path communicating with said discharge port and an energy generating element for generating energy utilized for discharging ink; and an ink containing section having an ink containing member for containing ink to be supplied to said recording head section, wherein said ink containing member is provided in the whole of an ink containing area of said ink containing section and comprises a first ink containing element and a second ink containing element, the porosity of said first ink containing element being lower than that of said second ink containing element and said first ink containing element and said second ink containing element being sequentially arranged in said ink containing section from a side of said ink containing section where ink is supplied to said recording head section.

42. An ink tank for use in an ink jet recording apparatus comprising a recording head having a discharge port for discharging ink, said ink tank being connected to said recording head to record by supplying ink contained in said ink tank to said recording head and comprising an ink containing member provided along substantially the whole ink containable area of said ink tank, wherein:

said ink containing member comprises a first ink containing element and a second ink containing element, the porosity of said first ink containing element being lower than that of said second ink containing element; and said first ink containing element and said second ink containing element are sequentially arranged in said ink tank from a side of said ink tank where ink is supplied to said recording head.

43. An ink filling method for supplying ink to an ink jet head cartridge having an integral recording head section and ink tank section, the ink tank section being filled with an ink absorbing member, wherein the cartridge is removably attachable to a recording apparatus, said method comprising the steps of:

supplying ink to the ink tank section by inserting an ink filling tube into an opening section provided at a side of the cartridge and connected to the ink tank;

exhausting air in the ink tank section, as ink is supplied to the ink tank section, from an opening for communicating the interior of the ink tank with the atmosphere or from a discharge port of the recording head section; and terminating the ink supplying step by sealing the opening section with a sealing member.

44. An ink jet recording head comprising:

a recording head section having a discharge port for discharging ink and an energy generating element provided correspondingly to said discharge port for generating energy utilized for discharging ink;

an ink containing section for containing ink to be supplied to said recording head section, said ink containing section having a vent hole for communicating the interior of said ink containing section with atmosphere;

an ink supply path communicating said recording head section with said ink containing section to supply ink to said recording head section; and an ink injection path for supplying ink from outside said recording head to said ink containing section, said ink injection path communicating with said ink supply path, and said ink supply path forming a part of said ink injection path.

* * * * *

UNITED STATES PATENT AND TRADEMARK OFFICE

CERTIFICATE OF CORRECTION

PATENT NO. : 5,182,581

DATED : January 26, 1993

INVENTOR(S) : MAKOTO KASHIMURA, ET AL.

It is certified that error appears in the above-identified patent and that said Letters Patent is hereby corrected as shown below:

COLUMN 1

Line 46, "instable" should read --unstable--.

COLUMN 4

Line 13, "or" should read --of--.

COLUMN 6

Line 37, "Cummunication" should read --Communication--.

COLUMN 9

Line 49, "embodiment" should read --embodiments--.
Line 52, "a" should read --an--.

COLUMN 10

Line 46, "and" (second occurrence) should be deleted.
Line 53, "and" should be deleted.

COLUMN 11

Line 5, "and" (first occurrence) should be deleted.
Line 6, "nor" should read --not--.
Line 24, "diameter ϕ5" should read --diameter--.

COLUMN 12

Line 23, "end 17A, in" should read --end 17A. In--.
Line 35, "the" should be deleted.
Line 36, "need" should read --no need--.

UNITED STATES PATENT AND TRADEMARK OFFICE

CERTIFICATE OF CORRECTION

PATENT NO. : 5,182,581

DATED : January 26, 1993

INVENTOR(S) : MAKOTO KASHIMURA, ET AL.

It is certified that error appears in the above-identified patent and that said Letters Patent is hereby corrected as shown below:

COLUMN 14

Line 32, "contactness" should read --contact--.

COLUMN 16

Line 15, "have" should read --has--.

COLUMN 17

Line 8, "leaks" should read --leak--.
Line 28, "of" should be deleted.
Line 41, "instable" should read --unstable--.

COLUMN 18

Line 12, "instable" should read --unstable--.

COLUMN 19

Line 1, "claim 3," should read --claim 4,--.
Line 43, "head" should read --heat--.

COLUMN 20

Line 27, "a" should be deleted.

COLUMN 21

Line 3, "combinations" should read --combination-- and "to" should be deleted.

UNITED STATES PATENT AND TRADEMARK OFFICE

CERTIFICATE OF CORRECTION

PATENT NO. : 5,182,581

DATED : January 26, 1993

INVENTOR(S) : MAKOTO KASHIMURA, ET AL.

It is certified that error appears in the above-identified patent and that said Letters Patent is hereby corrected as shown below:

COLUMN 23

Line 60, "discharge ink. heat energy and" should read --discharge of ink.--.

Line 61 should be deleted.

Signed and Sealed this

Twenty-second Day of February, 1994

Bruce Lehman

*Attest:*

BRUCE LEHMAN

*Attesting Officer*

*Commissioner of Patents and Trademarks*

--